US012716693B2

(12) United States Patent
Roberts et al.

(10) Patent No.: US 12,716,693 B2
(45) Date of Patent: Aug. 25, 2026

(54) CARTRIDGE IDENTIFIER FOR A CONDUCTED ELECTRICAL WEAPON

(71) Applicant: Axon Enterprise, Inc., Scottsdale, AZ (US)

(72) Inventors: Michael Roberts, San Francisco, CA (US); Dubravko Zekanovic, Scottsdale, AZ (US); Francisco Figueroa-del Pozo, Scottsdale, AZ (US); Trevor Ryan, Tahoe City, CA (US); Samuel Driscoll, Phoenix, AZ (US)

(73) Assignee: AXON ENTERPRISE, INC., Scottsdale, AZ (US)

( * ) Notice: Subject to any disclaimer, the term of this patent is extended or adjusted under 35 U.S.C. 154(b) by 140 days.

(21) Appl. No.: 18/677,582

(22) Filed: May 29, 2024

(65) Prior Publication Data

US 2026/0036406 A1 Feb. 5, 2026

Related U.S. Application Data

(63) Continuation of application No. 17/844,951, filed on Jun. 21, 2022, now Pat. No. 12,013,215.

(60) Provisional application No. 63/213,067, filed on Jun. 21, 2021.

(51) Int. Cl.
*F42B 5/02* (2006.01)
*F41H 13/00* (2006.01)

(52) U.S. Cl.
CPC ..... *F41H 13/0025* (2013.01); *F42B 5/025* (2013.01)

(58) Field of Classification Search
CPC .... F42B 8/00; F42B 8/02; F42B 33/14; F42B 5/025; F41H 13/0025
See application file for complete search history.

(56) References Cited

U.S. PATENT DOCUMENTS

| | | | |
|---|---|---|---|
| 1,632,156 | A | 6/1927 | Samuel |
| 2,926,566 | A | 3/1960 | Atkins et al. |
| 5,831,199 | A | 11/1998 | McNulty, Jr. et al. |
| 6,877,434 | B1 | 4/2005 | McNulty, Jr. |
| 7,950,176 | B1 | 5/2011 | Nemtyshkin et al. |
| 7,950,329 | B1 | 5/2011 | Nemtyshkin et al. |

(Continued)

FOREIGN PATENT DOCUMENTS

| | | | |
|---|---|---|---|
| CN | 207351302 | U | 5/2018 |
| CN | 108444337 | A | 8/2018 |

(Continued)

OTHER PUBLICATIONS

Intellectual Property Office of Singapore, Notice of Eligibility of Grant for Singapore Patent Application No. 11202309646R, mailed Sep. 15, 2025.

(Continued)

*Primary Examiner* — Jonathan C Weber
(74) *Attorney, Agent, or Firm* — Justin Powley

(57) ABSTRACT

A magazine for a conducted electrical weapon may include a bore configured to receive a cartridge. The bore may be sized and shaped to receive a cartridge having a specific cartridge type. A cartridge may comprise a cartridge identifier coupled to an outer surface of the cartridge. The cartridge identifier may include a physical property indicating a cartridge type of the cartridge. The cartridge identifier may allow the cartridge to be correctly received into the bore of the magazine.

20 Claims, 6 Drawing Sheets

(56) References Cited

U.S. PATENT DOCUMENTS

| | | | |
|---|---|---|---|
| 8,342,098 | B2 | 1/2013 | Shalev et al. |
| 10,066,905 | B2 | 9/2018 | Heroor et al. |
| 10,161,722 | B1 | 12/2018 | Salisbury et al. |
| 10,168,127 | B1 | 1/2019 | Salisbury et al. |
| 10,598,467 | B1 | 3/2020 | Mcdermit et al. |
| 10,731,953 | B2 | 8/2020 | Petrovic et al. |
| 11,041,698 | B2 | 6/2021 | Nemtyshkin et al. |
| 11,519,685 | B1 | 12/2022 | Edminster et al. |
| 2006/0026884 | A1 | 2/2006 | Cerovic et al. |
| 2006/0027127 | A1 | 2/2006 | Cerovic et al. |
| 2006/0207466 | A1 | 9/2006 | McNulty et al. |
| 2007/0070574 | A1 | 3/2007 | Nerheim et al. |
| 2010/0050856 | A1 | 3/2010 | Baldwin |
| 2010/0275806 | A1 | 11/2010 | Gavin et al. |
| 2011/0002077 | A1 | 1/2011 | Brundula et al. |
| 2011/0063770 | A1 | 3/2011 | Brundula et al. |
| 2012/0017793 | A1 | 1/2012 | Huffman |
| 2012/0262293 | A1 | 10/2012 | Brave et al. |
| 2014/0045146 | A1 | 2/2014 | Otte et al. |
| 2015/0002981 | A1 | 1/2015 | Klug et al. |
| 2015/0125828 | A1 | 5/2015 | Otte et al. |
| 2017/0059661 | A1 | 3/2017 | Foldyna |
| 2018/0283829 | A1 | 10/2018 | Petrovic et al. |
| 2018/0364017 | A1* | 12/2018 | Peterson ..... F42B 14/02 |
| 2019/0128650 | A1 | 5/2019 | Kim |
| 2020/0109933 | A1 | 4/2020 | Brundula et al. |
| 2020/0284556 | A1 | 9/2020 | Nemtyshkin et al. |
| 2021/0364256 | A1 | 11/2021 | Pirc et al. |
| 2022/0082357 | A1 | 3/2022 | Smith et al. |
| 2022/0228841 | A1 | 7/2022 | Smith et al. |

FOREIGN PATENT DOCUMENTS

| | | | |
|---|---|---|---|
| EP | 1762813 | A1 | 3/2007 |
| EP | 1762814 | A1 | 3/2007 |
| KR | 101890759 | B1 | 3/2018 |
| KR | 101872709 | B1 | 7/2018 |
| RU | 2275576 | C1 | 4/2006 |
| RU | 68671 | U1 | 11/2007 |
| RU | 2351871 | C1 | 4/2009 |
| RU | 2477441 | C1 | 3/2013 |
| RU | 2480704 | C2 | 4/2013 |
| RU | 2526159 | C2 | 8/2014 |
| RU | 2527242 | C2 | 8/2014 |
| RU | 2632828 | C2 | 10/2017 |
| RU | 2648562 | C1 | 3/2018 |
| RU | 2684807 | C2 | 4/2019 |
| TW | 202113301 | A | 4/2021 |
| WO | 2008030243 | A2 | 3/2008 |
| WO | 2009025575 | A1 | 2/2009 |
| WO | 820090025575 | A1 | 2/2009 |
| WO | 2010008650 | A2 | 1/2010 |
| WO | 2020030201 | A1 | 2/2020 |
| WO | 2020096545 | A2 | 5/2020 |
| WO | 2021101604 | A1 | 5/2021 |
| WO | 2021216702 | A1 | 10/2021 |
| WO | 2022261119 | A1 | 12/2022 |

OTHER PUBLICATIONS

Taiwan Patent Office, Office Action for Taiwanese Patent Application No. 113130803 mailed Mar. 5, 2025.

Korean Intellectual Property Office, International Search Report for International Application No. PCT/US2022/034230 mailed Feb. 28, 2023.

Taiwanese Patent Office, Office Action for Taiwan Application No. 111122846 mailed Aug. 17, 2023.

Korea Patent Office, Office Action for Korean Patent Application No. 10-2024-7002088, mailed Dec. 27, 2025.

* cited by examiner

CARTRIDGE IDENTIFIER FOR A CONDUCTED ELECTRICAL WEAPON

FIELD OF THE INVENTION

Embodiments of the present disclosure relate to a conducted electrical weapon ("CEW").

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers refer to similar elements and steps throughout the figures.

Figure 1:
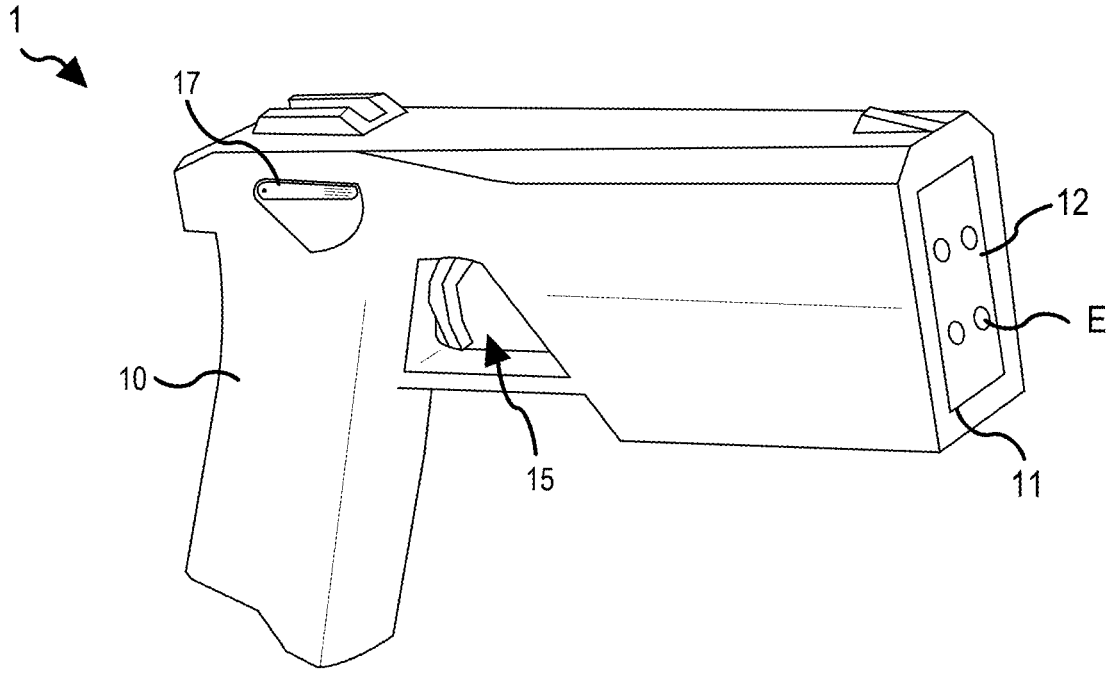
FIG. 1 is a perspective view of a conducted electrical weapon ("CEW"), in accordance with various embodiments.

Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

DETAILED DESCRIPTION

The detailed description of exemplary embodiments herein makes reference to the accompanying drawings, which show exemplary embodiments by way of illustration. While these embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation.

The scope of the disclosure is defined by the appended claims and their legal equivalents rather than by merely the examples described. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, coupled, connected, or the like may include permanent, removable, temporary, partial, full, and/or any other possible attachment option. Surface shading lines may be used throughout the figures to denote different parts but not necessarily to denote the same or different materials.

Systems, methods, and apparatuses may be used to interfere with voluntary locomotion (e.g., walking, running, moving, etc.) of a target. For example, a CEW may be used to deliver a current (e.g., stimulus signal, pulses of current, pulses of charge, etc.) through tissue of a human or animal target. Although typically referred to as a conducted electrical weapon, as described herein a "CEW" may refer to a conducted electrical weapon, a conducted energy weapon, an electronic control device, and/or any other similar device or apparatus configured to provide a stimulus signal through one or more deployed projectiles (e.g., electrodes).

A stimulus signal carries a charge into target tissue. The stimulus signal may interfere with voluntary locomotion of the target. The stimulus signal may cause pain. The pain may also function to encourage the target to stop moving. The stimulus signal may cause skeletal muscles of the target to become stiff (e.g., lock up, freeze, etc.). The stiffening of the muscles in response to a stimulus signal may be referred to as neuromuscular incapacitation ("NMI"). NMI disrupts voluntary control of the muscles of the target. The inability of the target to control its muscles interferes with locomotion of the target.

A stimulus signal may be delivered through the target via terminals coupled to the CEW. Delivery via terminals may be referred to as a local delivery (e.g., a local stun, a drive stun, etc.). During local delivery, the terminals are brought close to the target by positioning the CEW proximate to the target. The stimulus signal is delivered through the target's tissue via the terminals. To provide local delivery, the user of the CEW is generally within arm's reach of the target and brings the terminals of the CEW into contact with or proximate to the target.

A stimulus signal may be delivered through the target via one or more (typically at least two) wire-tethered electrodes. Delivery via wire-tethered electrodes may be referred to as a remote delivery (e.g., a remote stun). During a remote delivery, the CEW may be separated from the target up to the length (e.g., 15 feet, 20 feet, 30 feet, etc.) of the wire tether. The CEW launches the electrodes towards the target. As the electrodes travel toward the target, the respective wire tethers deploy behind the electrodes. The wire tether electrically couples the CEW to the electrode. The electrode may electrically couple to the target thereby coupling the CEW to the target. In response to the electrodes connecting with, impacting on, or being positioned proximate to the target's tissue, the current may be provided through the target via the electrodes (e.g., a circuit is formed through the first tether and the first electrode, the target's tissue, and the second electrode and the second tether).

Terminals or electrodes that contact or are proximate to the target's tissue deliver the stimulus signal through the target. Contact of a terminal or electrode with the target's tissue establishes an electrical coupling (e.g., circuit) with the target's tissue. Electrodes may include a spear that may pierce the target's tissue to contact the target. A terminal or electrode that is proximate to the target's tissue may use ionization to establish an electrical coupling with the target's tissue. Ionization may also be referred to as arcing.

In use (e.g., during deployment), a terminal or electrode may be separated from the target's tissue by the target's clothing or a gap of air. In various embodiments, a signal generator of the CEW may provide the stimulus signal (e.g., current, pulses of current, etc.) at a high voltage (e.g., in the range of 40,000 to 100,000 volts) to ionize the air in the clothing or the air in the gap that separates the terminal or electrode from the target's tissue. Ionizing the air establishes a low impedance ionization path from the terminal or electrode to the target's tissue that may be used to deliver the stimulus signal into the target's tissue via the ionization path. The ionization path persists (e.g., remains in existence, lasts, etc.) as long as the current of a pulse of the stimulus signal is provided via the ionization path. When the current ceases or is reduced below a threshold (e.g., amperage, voltage), the ionization path collapses (e.g., ceases to exist) and the terminal or electrode is no longer electrically coupled to the target's tissue. Lacking the ionization path, the impedance between the terminal or electrode and target tissue is high. A high voltage in the range of about 50,000 volts can ionize air in a gap of up to about one inch.

A CEW may provide a stimulus signal as a series of current pulses. Each current pulse may include a high voltage portion (e.g., 40,000-100,000 volts) and a low voltage portion (e.g., 500-6,000 volts). The high voltage portion of a pulse of a stimulus signal may ionize air in a gap between an electrode or terminal and a target to electrically couple the electrode or terminal to the target. In response to the electrode or terminal being electrically coupled to the target, the low voltage portion of the pulse delivers an amount of charge into the target's tissue via the ionization path. In response to the electrode or terminal being electrically coupled to the target by contact (e.g., touching, spear embedded into tissue, etc.), the high portion of the pulse and the low portion of the pulse both deliver charge to the target's tissue. Generally, the low voltage portion of the pulse delivers a majority of the charge of the pulse into the target's tissue. In various embodiments, the high voltage portion of a pulse of the stimulus signal may be referred to as the spark or ionization portion. The low voltage portion of a pulse may be referred to as the muscle portion.

In various embodiments, a signal generator of the CEW may provide the stimulus signal (e.g., current, pulses of current, etc.) at only a low voltage (e.g., less than 2,000 volts). The low voltage stimulus signal may not ionize the air in the clothing or the air in the gap that separates the terminal or electrode from the target's tissue. A CEW having a signal generator providing stimulus signals at only a low voltage (e.g., a low voltage signal generator) may require deployed electrodes to be electrically coupled to the target by contact (e.g., touching, spear embedded into tissue, etc.).

A CEW may include at least two terminals at the face of the CEW. A CEW may include two terminals for each bay that accepts a magazine (e.g., deployment unit). The terminals are spaced apart from each other. In response to the electrodes of the magazine in the bay having not been deployed, the high voltage impressed across the terminals will result in ionization of the air between the terminals. The arc between the terminals may be visible to the naked eye. In response to a launched electrode not electrically coupling to a target, the current that would have been provided via the electrodes may arc across the face of the CEW via the terminals.

The likelihood that the stimulus signal will cause NMI increases when the electrodes that deliver the stimulus signal are spaced apart at least 6 inches (15.24 centimeters) so that the current from the stimulus signal flows through the at least 6 inches of the target's tissue. In various embodiments, the electrodes preferably should be spaced apart at least 12 inches (30.48 centimeters) on the target. Because the terminals on a CEW are typically less than 6 inches apart, a stimulus signal delivered through the target's tissue via terminals likely will not cause NMI, only pain.

A series of pulses may include two or more pulses separated in time. Each pulse delivers an amount of charge into the target's tissue. In response to the electrodes being appropriately spaced (as discussed above), the likelihood of inducing NMI increases as each pulse delivers an amount of charge in the range of 55 microcoulombs to 71 microcoulombs per pulse. The likelihood of inducing NMI increases when the rate of pulse delivery (e.g., rate, pulse rate, repetition rate, etc.) is between 11 pulses per second ("pps") and 50 pps. Pulses delivered at a higher rate may provide less charge per pulse to induce NMI. Pulses that deliver more charge per pulse may be delivered at a lesser rate to induce NMI. In various embodiments, a CEW may be hand-held and use batteries to provide the pulses of the stimulus signal. In response to the amount of charge per pulse being high and the pulse rate being high, the CEW may use more energy than is needed to induce NMI. Using more energy than is needed depletes batteries more quickly.

Empirical testing has shown that the power of the battery may be conserved with a high likelihood of causing NMI in response to the pulse rate being less than 44 pps and the charge per a pulse being about 63 microcoulombs. Empirical testing has shown that a pulse rate of 22 pps and 63 microcoulombs per a pulse via a pair of electrodes will induce NMI when the electrode spacing is at least 12 inches (30.48 centimeters).

In various embodiments, a CEW may include a handle and one or more magazines (e.g., deployment units, etc.). The handle may include one or more bays for receiving the magazine(s). Each magazine may be removably positioned in (e.g., inserted into, coupled to, etc.) a bay. Each magazine may releasably electrically, electronically, and/or mechanically couple to a bay. A deployment of the CEW may launch one or more electrodes from the magazine and toward a target to remotely deliver the stimulus signal through the target.

In various embodiments, a magazine may include two or more electrodes (e.g., projectiles, cartridges, etc.) that are launched at the same time. In various embodiments, a magazine may include two or more electrodes that may each be launched individually at separate times. In various embodiments, a magazine may include a single electrode configured to be launched from the magazine. Launching the electrodes may be referred to as activating (e.g., firing) a magazine or electrode. After use (e.g., activation, firing), a magazine may be removed from the bay and replaced with an unused (e.g., not fired, not activated) magazine to permit launch of additional electrodes.

Figure 2:
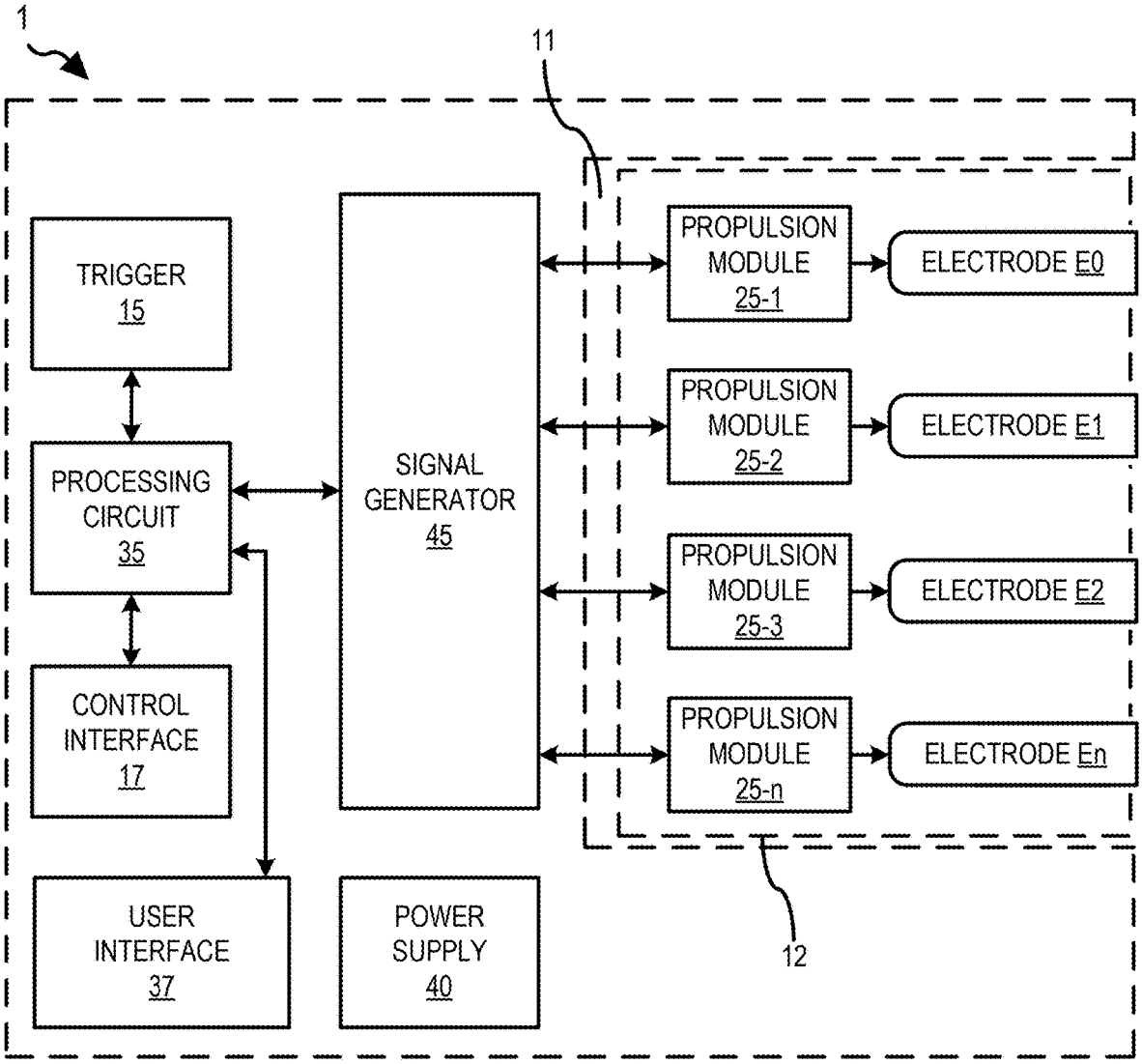
FIG. 2 is a schematic view of a CEW, in accordance with various embodiments.

In various embodiments, and with reference to FIGS. 1 and 2, a CEW 1 is disclosed. CEW 1 may be similar to, or have similar aspects and/or components with, any CEW discussed herein. CEW 1 may comprise a housing 10 and a magazine 12. It should be understood by one skilled in the art that FIG. 2 is a schematic representation of CEW 1, and one or more of the components of CEW 1 may be located in any suitable position within, or external to, housing 10.

Housing 10 may be configured to house various components of CEW 1 that are configured to enable deployment of magazine 12, provide an electrical current to magazine 12, and otherwise aid in the operation of CEW 1, as discussed further herein. Although depicted as a firearm in FIG. 1, housing 10 may comprise any suitable shape and/or size. Housing 10 may comprise a handle end opposite a deployment end. A deployment end may be configured, and sized and shaped, to receive one or more magazine 12. A handle end may be sized and shaped to be held in a hand of a user. For example, a handle end may be shaped as a handle to enable hand-operation of CEW 1 by the user. In various embodiments, a handle end may also comprise contours shaped to fit the hand of a user, for example, an ergonomic grip. A handle end may include a surface coating, such as, for example, a non-slip surface, a grip pad, a rubber texture, and/or the like. As a further example, a handle end may be wrapped in leather, a colored print, and/or any other suitable material, as desired.

In various embodiments, housing 10 may comprise various mechanical, electronic, and/or electrical components configured to aid in performing the functions of CEW 1. For example, housing 10 may comprise one or more triggers 15, control interfaces 17, processing circuits 35, power supplies 40, and/or signal generators 45. Housing 10 may include a guard (e.g., trigger guard). A guard may define an opening formed in housing 10. A guard may be located on a center region of housing 10 (e.g., as depicted in FIG. 1), and/or in any other suitable location on housing 10. Trigger 15 may be disposed within a guard. A guard may be configured to protect trigger 15 from unintentional physical contact (e.g., an unintentional activation of trigger 15). A guard may surround trigger 15 within housing 10.

In various embodiments, trigger 15 be coupled to an outer surface of housing 10, and may be configured to move, slide, rotate, or otherwise become physically depressed or moved upon application of physical contact. For example, trigger 15 may be actuated by physical contact applied to trigger 15 from within a guard. Trigger 15 may comprise a mechanical or electromechanical switch, button, trigger, or the like. For example, trigger 15 may comprise a switch, a pushbutton, and/or any other suitable type of trigger. Trigger 15 may be mechanically and/or electronically coupled to processing circuit 35. In response to trigger 15 being activated (e.g., depressed, pushed, etc. by the user), processing circuit 35 may enable deployment of (or cause deployment of) one or more magazine 12 from CEW 1, as discussed further herein.

In various embodiments, power supply 40 may be configured to provide power to various components of CEW 1. For example, power supply 40 may provide energy for operating the electronic and/or electrical components (e.g., parts, subsystems, circuits, etc.) of CEW 1 and/or one or more magazine 12. Power supply 40 may provide electrical power. Providing electrical power may include providing a current at a voltage. Power supply 40 may be electrically coupled to processing circuit 35 and/or signal generator 45. In various embodiments, in response to a control interface comprising electronic properties and/or components, power supply 40 may be electrically coupled to the control interface. In various embodiments, in response to trigger 15 comprising electronic properties or components, power supply 40 may be electrically coupled to trigger 15. Power supply 40 may provide an electrical current at a voltage. Electrical power from power supply 40 may be provided as a direct current ("DC"). Electrical power from power supply 40 may be provided as an alternating current ("AC"). Power supply 40 may include a battery. The energy of power supply 40 may be renewable or exhaustible, and/or replaceable. For example, power supply 40 may comprise one or more rechargeable or disposable batteries. In various embodiments, the energy from power supply 40 may be converted from one form (e.g., electrical, magnetic, thermal) to another form to perform the functions of a system.

Power supply 40 may provide energy for performing the functions of CEW 1. For example, power supply 40 may provide the electrical current to signal generator 45 that is provided through a target to impede locomotion of the target (e.g., via magazine 12). Power supply 40 may provide the energy for a stimulus signal. Power supply 40 may provide the energy for other signals, including an ignition signal, as discussed further herein.

In various embodiments, processing circuit 35 may comprise any circuitry, electrical components, electronic components, software, and/or the like configured to perform various operations and functions discussed herein. For example, processing circuit 35 may comprise a processing circuit, a processor, a digital signal processor, a microcontroller, a microprocessor, an application specific integrated circuit (ASIC), a programmable logic device, logic circuitry, state machines, MEMS devices, signal conditioning circuitry, communication circuitry, a computer, a computer-based system, a radio, a network appliance, a data bus, an address bus, and/or any combination thereof. In various embodiments, processing circuit 35 may include passive electronic devices (e.g., resistors, capacitors, inductors, etc.) and/or active electronic devices (e.g., op amps, comparators, analog-to-digital converters, digital-to-analog converters, programmable logic, SRCs, transistors, etc.). In various embodiments, processing circuit 35 may include data buses, output ports, input ports, timers, memory, arithmetic units, and/or the like.

In various embodiments, processing circuit 35 may include signal conditioning circuity. Signal conditioning circuitry may include level shifters to change (e.g., increase, decrease) the magnitude of a voltage (e.g., of a signal) before receipt by processing circuit 35 or to shift the magnitude of a voltage provided by processing circuit 35.

In various embodiments, processing circuit 35 may be configured to control and/or coordinate operation of some or all aspects of CEW 1. For example, processing circuit 35 may include (or be in communication with) memory configured to store data, programs, and/or instructions. The memory may comprise a tangible non-transitory computer-readable memory. Instructions stored on the tangible non-transitory memory may allow processing circuit 35 to perform various operations, functions, and/or steps, as described herein.

In various embodiments, the memory may comprise any hardware, software, and/or database component capable of storing and maintaining data. For example, a memory unit may comprise a database, data structure, memory component, or the like. A memory unit may comprise any suitable non-transitory memory known in the art, such as, an internal memory (e.g., random access memory (RAM), read-only memory (ROM), solid state drive (SSD), etc.), removable memory (e.g., an SD card, an xD card, a CompactFlash card, etc.), or the like.

Processing circuit 35 may be configured to provide and/or receive electrical signals whether digital and/or analog in form. Processing circuit 35 may provide and/or receive digital information via a data bus using any protocol. Processing circuit 35 may receive information, manipulate the received information, and provide the manipulated information. Processing circuit 35 may store information and retrieve stored information. Information received, stored, and/or manipulated by processing circuit 35 may be used to perform a function, control a function, and/or to perform an operation or execute a stored program.

Processing circuit 35 may control the operation and/or function of other circuits and/or components of CEW 1.

Processing circuit 35 may receive status information regarding the operation of other components, perform calculations with respect to the status information, and provide commands (e.g., instructions) to one or more other components. Processing circuit 35 may command another component to start operation, continue operation, alter operation, suspend operation, cease operation, or the like. Commands and/or status may be communicated between processing circuit 35 and other circuits and/or components via any type of bus (e.g., SPI bus) including any type of data/address bus.

In various embodiments, processing circuit 35 may be mechanically and/or electronically coupled to trigger 15. Processing circuit 35 may be configured to detect an activation, actuation, depression, input, etc. (collectively, an "activation event") of trigger 15. In response to detecting the activation event, processing circuit 35 may be configured to perform various operations and/or functions, as discussed further herein. Processing circuit 35 may also include a sensor (e.g., a trigger sensor) attached to trigger 15 and configured to detect an activation event of trigger 15. The sensor may comprise any suitable sensor, such as a mechanical and/or electronic sensor capable of detecting an activation event in trigger 15 and reporting the activation event to processing circuit 35.

In various embodiments, processing circuit 35 may be mechanically and/or electronically coupled to control interface 17. Processing circuit 35 may be configured to detect an activation, actuation, depression, input, etc. (collectively, a "control event") of control interface 17. In response to detecting the control event, processing circuit 35 may be configured to perform various operations and/or functions, as discussed further herein. Processing circuit 35 may also include a sensor (e.g., a control sensor) attached to control interface 17 and configured to detect a control event of control interface 17. The sensor may comprise any suitable mechanical and/or electronic sensor capable of detecting a control event in control interface 17 and reporting the control event to processing circuit 35.

In various embodiments, processing circuit 35 may be electrically and/or electronically coupled to power supply 40. Processing circuit 35 may receive power from power supply 40. The power received from power supply 40 may be used by processing circuit 35 to receive signals, process signals, and transmit signals to various other components in CEW 1. Processing circuit 35 may use power from power supply 40 to detect an activation event of trigger 15, a control event of control interface 17, or the like, and generate one or more control signals in response to the detected events. The control signal may be based on the control event and the activation event. The control signal may be an electrical signal.

In various embodiments, processing circuit 35 may be electrically and/or electronically coupled to signal generator 45. Processing circuit 35 may be configured to transmit or provide control signals to signal generator 45 in response to detecting an activation event of trigger 15. Multiple control signals may be provided from processing circuit 35 to signal generator 45 in series. In response to receiving the control signal, signal generator 45 may be configured to perform various functions and/or operations, as discussed further herein.

In various embodiments, signal generator 45 may be configured to receive one or more control signals from processing circuit 35. Signal generator 45 may provide an ignition signal to magazine 12 based on the control signals. Signal generator 45 may be electrically and/or electronically coupled to processing circuit 35 and/or magazine 12. Signal generator 45 may be electrically coupled to power supply 40. Signal generator 45 may use power received from power supply 40 to generate an ignition signal. For example, signal generator 45 may receive an electrical signal from power supply 40 that has first current and voltage values. Signal generator 45 may transform the electrical signal into an ignition signal having second current and voltage values. The transformed second current and/or the transformed second voltage values may be different from the first current and/or voltage values. The transformed second current and/or the transformed second voltage values may be the same as the first current and/or voltage values. Signal generator 45 may temporarily store power from power supply 40 and rely on the stored power entirely or in part to provide the ignition signal. Signal generator 45 may also rely on received power from power supply 40 entirely or in part to provide the ignition signal, without needing to temporarily store power.

Signal generator 45 may be controlled entirely or in part by processing circuit 35. In various embodiments, signal generator 45 and processing circuit 35 may be separate components (e.g., physically distinct and/or logically discrete). Signal generator 45 and processing circuit 35 may be a single component. For example, a control circuit within housing 10 may at least include signal generator 45 and processing circuit 35. The control circuit may also include other components and/or arrangements, including those that further integrate corresponding function of these elements into a single component or circuit, as well as those that further separate certain functions into separate components or circuits.

Signal generator 45 may be controlled by the control signals to generate an ignition signal having a predetermined current value or values. For example, signal generator 45 may include a current source. The control signal may be received by signal generator 45 to activate the current source at a current value of the current source. An additional control signal may be received to decrease a current of the current source. For example, signal generator 45 may include a pulse width modification circuit coupled between a current source and an output of the control circuit. A second control signal may be received by signal generator 45 to activate the pulse width modification circuit, thereby decreasing a non-zero period of a signal generated by the current source and an overall current of an ignition signal subsequently output by the control circuit. The pulse width modification circuit may be separate from a circuit of the current source or, alternatively, integrated within a circuit of the current source. Various other forms of signal generators 45 may alternatively or additionally be employed, including those that apply a voltage over one or more different resistances to generate signals with different currents. In various embodiments, signal generator 45 may include a high-voltage module configured to deliver an electrical current having a high voltage. In various embodiments, signal generator 45 may include a low-voltage module configured to deliver an electrical current having a lower voltage, such as, for example, 2,000 volts.

Responsive to receipt of a signal indicating activation of trigger 15 (e.g., an activation event), a control circuit provides an ignition signal to magazine 12 (or an electrode in magazine 12). For example, signal generator 45 may provide an electrical signal as an ignition signal to magazine 12 in response to receiving a control signal from processing circuit 35. In various embodiments, the ignition signal may be separate and distinct from a stimulus signal. For example, a stimulus signal in CEW 1 may be provided to a different circuit within magazine 12, relative to a circuit to which an ignition signal is provided. Signal generator 45 may be configured to generate a stimulus signal. In various embodiments, a second, separate signal generator, component, or circuit (not shown) within housing 10 may be configured to generate the stimulus signal. Signal generator 45 may also provide a ground signal path for magazine 12, thereby completing a circuit for an electrical signal provided to magazine 12 by signal generator 45. The ground signal path may also be provided to magazine 12 by other elements in housing 10, including power supply 40.

In various embodiments, a bay 11 of housing 10 may be configured (to receive one or more magazine 12. Bay 11 may comprise an opening in an end of housing 10 sized and shaped to receive one or more magazine 12. Bay 11 may include one or more mechanical features configured to removably couple one or more magazine 12 within bay 11. Bay 11 of housing 10 may be configured to receive a single magazine, two magazines, three magazines, nine magazines, or any other number of magazines.

Magazine 12 may comprise one or more propulsion modules 25 and one or more electrodes E. For example, a magazine 12 may comprise a single propulsion module 25 configured to deploy a single electrode E. As a further example, a magazine 12 may comprise a single propulsion module 25 configured to deploy a plurality of electrodes E. As a further example, a magazine 12 may comprise a plurality of propulsion modules 25 and a plurality of electrodes E, with each propulsion module 25 configured to deploy one or more electrodes E. In various embodiments, and as depicted in FIG. 2, magazine 12 may comprise a first propulsion module 25-1 configured to deploy a first electrode E0, a second propulsion module 25-2 configured to deploy a second electrode E1, a third propulsion module 25-3 configured to deploy a third electrode E2, and a fourth propulsion module 25-4 configured to deploy a fourth electrode E3. Each series of propulsion modules and electrodes may be contained in the same and/or separate magazines.

In various embodiments, a propulsion module 25 may be coupled to, or in communication with one or more electrodes E in magazine 12. In various embodiments, magazine 12 may comprise a plurality of propulsion modules 25, with each propulsion module 25 coupled to, or in communication with, one or more electrodes E. A propulsion module 25 may comprise any device, propellant (e.g., air, gas, etc.), primer, or the like capable of providing a propulsion force in magazine 12. The propulsion force may include an increase in pressure caused by rapidly expanding gas within an area or chamber. The propulsion force may be applied to one or more electrodes E in magazine 12 to cause the deployment of the one or more electrodes E. A propulsion module 25 may provide the propulsion force in response to magazine 12 receiving an ignition signal, as previously discussed.

In various embodiments, the propulsion force may be directly applied to one or more electrodes E. For example, a propulsion force from propulsion module 25-1 may be provided directly to first electrode E0. A propulsion module 25 may be in fluid communication with one or more electrodes E to provide the propulsion force. For example, a propulsion force from propulsion module 25-1 may travel within a housing or channel of magazine 12 to first electrode E0. The propulsion force may travel via a manifold in magazine 12.

In various embodiments, the propulsion force may be provided indirectly to one or more electrodes E. For example, the propulsion force may be provided to a secondary source of propellant within propulsion system 125. The propulsion force may launch the secondary source of propellant within propulsion system 125, causing the secondary source of propellant to release propellant. A force associated with the released propellant may in turn provide a force to one or more electrodes E. A force generated by a secondary source of propellant may cause the one or more electrodes E to be deployed from the magazine 12 and CEW 1.

In various embodiments, each electrode E0, E1, E2, E3 may each comprise any suitable type of projectile. For example, one or more electrodes E may be or include a projectile, an electrode (e.g., an electrode dart), an entangling projectile, a payload projectile (e.g., comprising a liquid or gas substance), or the like. An electrode may include a spear portion, designed to pierce or attach proximate a tissue of a target in order to provide a conductive electrical path between the electrode and the tissue, as previously discussed herein.

Control interface 17 of CEW 1 may comprise, or be similar to, any control interface disclosed herein. In various embodiments, control interface 17 may be configured to control selection of firing modes in CEW 1. Controlling selection of firing modes in CEW 1 may include disabling firing of CEW 1 (e.g., a safety mode, etc.), enabling firing of CEW 1 (e.g., an active mode, a firing mode, an escalation mode, etc.), controlling deployment of magazine 12, and/or similar operations, as discussed further herein. In various embodiments, control interface 17 may also be configured to perform (or cause performance of) one or more operations that do not include the selection of firing modes. For example, control interface 17 may be configured to enable the selection of operating modes of CEW 1, selection of options within an operating mode of CEW 1, or similar selection or scrolling operations, as discussed further herein.

Control interface 17 may be located in any suitable location on or in housing 10. For example, control interface 17 may be coupled to an outer surface of housing 10. Control interface 17 may be coupled to an outer surface of housing 10 proximate trigger 15 and/or a guard of housing 10. Control interface 17 may be electrically, mechanically, and/or electronically coupled to processing circuit 35. In various embodiments, in response to control interface 17 comprising electronic properties or components, control interface 17 may be electrically coupled to power supply 40. Control interface 17 may receive power (e.g., electrical current) from power supply 40 to power the electronic properties or components.

Control interface 17 may be electronically or mechanically coupled to trigger 15. For example, and as discussed further herein, control interface 17 may function as a safety mechanism. In response to control interface 17 being set to a "safety mode," CEW 1 may be unable to launch electrodes from magazine 12. For example, control interface 17 may provide a signal (e.g., a control signal) to processing circuit 35 instructing processing circuit 35 to disable deployment of electrodes from magazine 12. As a further example, control interface 17 may electronically or mechanically prohibit trigger 15 from activating (e.g., prevent or disable a user from depressing trigger 15; prevent trigger 15 from launching an electrode; etc.).

Control interface 17 may comprise any suitable electronic or mechanical component capable of enabling selection of firing modes. For example, control interface 17 may comprise a fire mode selector switch, a safety switch, a safety catch, a rotating switch, a selection switch, a selective firing mechanism, and/or any other suitable mechanical control. As a further example, control interface 17 may comprise a slide, such as a handgun slide, a reciprocating slide, or the like. As a further example, control interface 17 may comprise a touch screen, user interface or display, or similar electronic visual component.

The safety mode may be configured to prohibit deployment of an electrode from magazine 12 in CEW 1. For example, in response to a user selecting the safety mode, control interface 17 may transmit a safety mode instruction to processing circuit 35. In response to receiving the safety mode instruction, processing circuit 35 may prohibit deployment of an electrode from magazine 12. Processing circuit 35 may prohibit deployment until a further instruction is received from control interface 17 (e.g., a firing mode instruction). As previously discussed, control interface 17 may also, or alternatively, interact with trigger 15 to prevent activation of trigger 15. In various embodiments, the safety mode may also be configured to prohibit deployment of a stimulus signal from signal generator 45, such as, for example, a local delivery.

The firing mode may be configured to enable deployment of one or more electrodes from magazine 12 in CEW 1. For example, and in accordance with various embodiments, in response to a user selecting the firing mode, control interface 17 may transmit a firing mode instruction to processing circuit 35. In response to receiving the firing mode instruction, processing circuit 35 may enable deployment of an electrode from magazine 12. In that regard, in response to trigger 15 being activated, processing circuit 35 may cause the deployment of one or more electrodes. Processing circuit 35 may enable deployment until a further instruction is received from control interface 17 (e.g., a safety mode instruction). As a further example, and in accordance with various embodiments, in response to a user selecting the firing mode, control interface 17 may also mechanically (or electronically) interact with trigger 15 of CEW 1 to enable activation of trigger 15.

In various embodiments, CEW 1 may deliver a stimulus signal via a circuit that includes signal generator 45 positioned in the handle of CEW 1. An interface (e.g., cartridge interface, magazine interface, etc.) on each magazine 12 inserted into housing 10 electrically couples to an interface (e.g., handle interface, housing interface, etc.) in handle housing 10. Signal generator 45 couples to each magazine 12, and thus to the electrodes E, via the handle interface and the magazine interface. A first filament couples to the interface of the magazine 12 and to a first electrode. A second filament couples to the interface of the magazine 12 and to a second electrode. The stimulus signal travels from signal generator 45, through the first filament and the first electrode, through target tissue, and through the second electrode and second filament back to signal generator 45.

In various embodiments, CEW 1 may further comprise one or more user interfaces 37. A user interface 37 may be configured to receive an input from a user of CEW 1 and/or transmit an output to the user of CEW 1. User interface 37 may be located in any suitable location on or in housing 10. For example, user interface 37 may be coupled to an outer surface of housing 10, or extend at least partially through the outer surface of housing 10. User interface 37 may be electrically, mechanically, and/or electronically coupled to processing circuit 35. In various embodiments, in response to user interface 37 comprising electronic or electrical properties or components, user interface 37 may be electrically coupled to power supply 40. User interface 37 may receive power (e.g., electrical current) from power supply 40 to power the electronic properties or components.

In various embodiments, user interface 37 may comprise one or more components configured to receive an input from a user. For example, user interface 37 may comprise one or more of an audio capturing module (e.g., microphone) configured to receive an audio input, a visual display (e.g., touchscreen, LCD, LED, etc.) configured to receive a manual input, a mechanical interface (e.g., button, switch, etc.) configured to receive a manual input, and/or the like. In various embodiments, user interface 37 may comprise one or more components configured to transmit or produce an output. For example, user interface 37 may comprise one or more of an audio output module (e.g., audio speaker) configured to output audio, a light-emitting component (e.g., flashlight, laser guide, etc.) configured to output light, a visual display (e.g., touchscreen, LCD, LED, etc.) configured to output a visual, and/or the like.

Figure 3A:
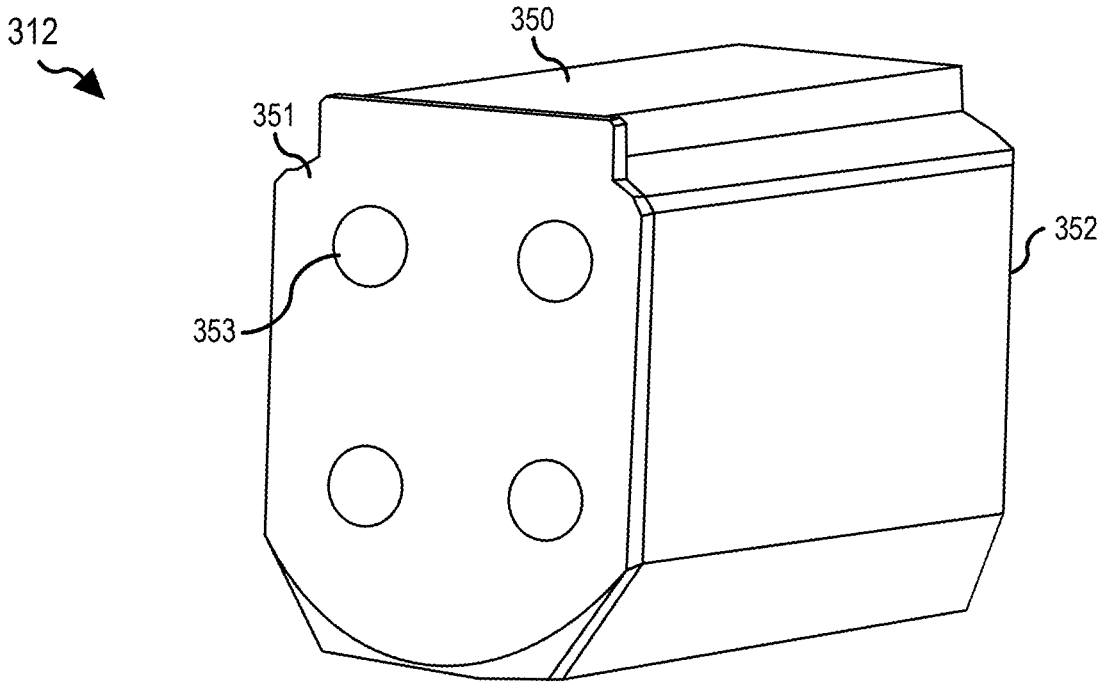
FIG. 3A is a front perspective view of a magazine for a CEW, in accordance with various embodiments.
Figure 3B:
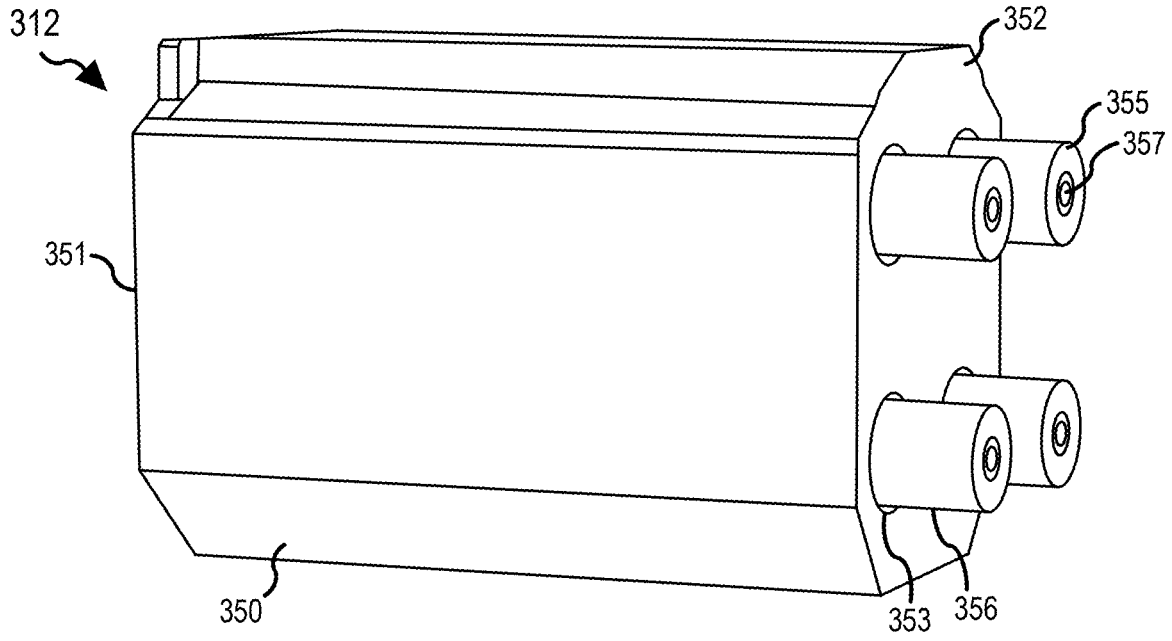
FIG. 3B is a rear perspective view of a magazine for a CEW, in accordance with various embodiments.

In various embodiments, and with reference to FIGS. 3A and 3B, a magazine 312 for a CEW is disclosed. Magazine 312 may be similar to any other magazine, deployment unit, or the like disclosed herein.

Magazine 312 may comprise a housing 350 sized and shaped to be inserted into the bay of a CEW handle, as previously discussed. Housing 350 may comprise a first end 351 (e.g., a deployment end, a front end, etc.) opposite a second end 352 (e.g., a loading end, a rear end, etc.). Magazine 312 may be configured to permit launch of one or more electrodes from first end 351 (e.g., electrodes are launched through first end 351). Magazine 312 may be configured to permit loading of one or more electrodes from second end 352. Second end 352 may also be configured to permit provision of electrical signals (e.g., stimulus signals, ignition signals, etc.) from the CEW to the one or more electrodes. In some embodiments, magazine 312 may also be configured to permit loading of one or more electrodes from first end 351.

In various embodiments, housing 350 may define one or more bores 353. A bore 353 may comprise an axial opening through housing 350, defined and open on first end 351 and/or second end 352. Each bore 353 may be configured to receive an electrode (or cartridge containing an electrode). Each bore 353 may be sized and shaped accordingly to receive and house an electrode (or cartridge containing an electrode) prior to and during deployment of the electrode from magazine 312. Each bore 353 may comprise any suitable deployment angle. One or more bores 353 may comprise similar deployment angles. One or more bores 353 may comprise different deployment angles. Housing 350 may comprise any suitable or desired number of bores 353, such as, for example, two bores, four bores (e.g., as depicted), five bores, nine bores, ten bores, and/or the like.

In various embodiments, magazine 312 may be configured to receive one or more cartridges 355. A cartridge 355 may comprise a body 356 housing an electrode and one or more components necessary to deploy the electrode from body 356. For example, cartridge 355 may comprise an electrode and a propulsion module. The electrode may be similar to any other electrode, projectile, or the like disclosed herein. The propulsion module may be similar to any other propulsion module, primer, or the like disclosed herein.

In various embodiments, cartridge 355 may comprise a cylindrical outer body 356 defining a hollow inner portion. The hollow inner portion may house an electrode (e.g., an electrode, a spear, a filament wire, etc.). The hollow inner portion may house a propulsion module configured to deploy the electrode from a first end of the cylindrical outer body 356. Cartridge 355 may include a piston positioned adjacent a second end of the electrode. Cartridge 355 may have the propulsion module positioned such that the piston is located between the electrode and the propulsion module. Cartridge 355 may also have a wad positioned adjacent the piston, where the wad is located between the propulsion module and the piston.

In various embodiments, a cartridge 355 may comprise a contact 357 on an end of body 356. Contact 357 may be configured to allow cartridge 355 to receive an electrical signal from a CEW handle. For example, contact 357 may comprise an electrical contact configured to enable the completion of an electrical circuit between cartridge 355 and a signal generator of the CEW handle. In that regard, contact 357 may be configured to transmit (or provide) a stimulus signal from the CEW handle to the electrode. As a further example, contact 357 may be configured to transmit (or provide) an electrical signal (e.g., an ignition signal) from the CEW handle to a propulsion module within the cartridge 355. For example, contact 357 may be configured to transmit (or provide) the electrical signal to a conductor of the propulsion module, thereby causing the conductor to heat up and ignite a pyrotechnic material inside the propulsion module. Ignition of the pyrotechnic material may cause the propulsion module to deploy (e.g., directly or indirectly) the electrode from the cartridge 355.

In operation, a cartridge 355 may be inserted into a bore 353 of a magazine 312. The magazine 312 may be inserted into the bay of a CEW handle, and/or coupled to an interposer of a CEW handle. The CEW may be operated to deploy an electrode from the cartridge 355 in magazine 312. Magazine 312 may be removed from the bay of the CEW handle. The cartridge 355 (e.g., a used cartridge, a spent cartridge, etc.) may be removed from the bore 353 of magazine 312. A new cartridge 355 may then be inserted into the same bore 353 of magazine 312 for additional deployments. The number of cartridges 355 that magazine 312 is capable of receiving may be dependent on a number of bores 353 in housing 350. For example, in response to housing 350 comprising four bores 353, magazine 312 may be configured to receive at most four cartridges 355 at the same time. As a further example, in response to housing 350 comprising ten bores 353, magazine 350 may be configured to receive at most ten cartridges 355 at the same time.

In various embodiments, a magazine for a CEW may be configured to receive one or more cartridges having a specific cartridge type. A magazine may comprise one or more mechanical features configured to allow the magazine to receive a cartridge having a specific cartridge type. A magazine may comprise one or more mechanical features configured to at least partially prevent a magazine from functioning properly in response to receiving a cartridge having a specific cartridge type not supported by the magazine (e.g., a specific cartridge type the magazine is not configured to receive).

In various embodiments, a magazine may be configured to receive cartridges each having a same cartridge type. In other embodiments, a magazine may be configured to receive one or more first cartridges having a first cartridge type and one or more second cartridges having a second cartridge type. In some embodiments, a magazine may be configured to receive a plurality of different cartridge types.

For example, a bore of a magazine may be sized and shaped to receive a cartridge having a complimentary size and shape. A cartridge with a non-complimentary size and/or shape may not be properly received by the magazine. For example, a cartridge with a non-complimentary size and/or shape may not fit into the bore, may extend too far into the bore, may not extend far enough into the bore, and/or the like.

A cartridge type may refer to capabilities, materials, features, payloads, and/or the like of a cartridge. In some embodiments a cartridge type may comprise a lethal payload. In other embodiments, a cartridge type may comprise a less-lethal or non-lethal payload. For example, a cartridge type may comprise a rubber bullet type, a standard electrode type, an article penetrating electrode type, a training projectile type, an entangling projectile type (e.g., a tether-based entangling projectile, a net, etc.), a scent-based projectile type, a pepper spray projectile type (e.g., oleoresin capsicum, OC spray), a tear gas projectile type (e.g., 2-chlorobenzalmalononitrile, CS spray), and/or the like.

In various embodiments, a cartridge type may also not comprise a payload (e.g., a non-payload type). For example, in some embodiments, a training cartridge, a virtual reality cartridge, and/or the like may comprise components that do not include a payload.

In various embodiments, a cartridge type may refer to propulsion capabilities of a cartridge such as, for example, a propulsion method, a propulsion speed, a propulsion type, and/or the like. In various embodiments, a cartridge type may refer to materials of a cartridge such as, for example, a non-metal cartridge body, a metal cartridge body, and/or the like.

In various embodiments, cartridges across different cartridge types may have a uniform form factor. For example, a cartridge of a first cartridge type may comprise a cartridge body substantially similar in size and shape to a cartridge of a second cartridge type. In that regard, to distinguish between different cartridge types and to allow a magazine to receive cartridges of only specific cartridge types, a cartridge may include a cartridge identifier coupled to an outer surface of the cartridge.

A cartridge identifier may comprise a physical property indicating a cartridge type of the cartridge the cartridge identifier is coupled to. The physical property may be configured to interface with a bore of a magazine to allow the magazine to correctly receive the cartridge. The physical property may also visually indicate the cartridge type to a user. The physical property may comprise a dimension, such as a length, a width, or a depth. The physical property may comprise a color, a shape, a design, a material, and/or the like.

The physical property may comprise a material. For example, the material may be configured to receive an impact force in response to a deployment of the cartridge. In that regard, the material may comprise a rubber material, a plastic material, or any other material configured to at least partially receive the impact force. The material of the cartridge identifier may be different from a material of a cartridge that the cartridge identifier is coupled to (e.g., a cartridge body may comprise a first material, a cartridge identifier may comprise a second material, and the first material may be different from the second material).

In various embodiments, a cartridge identifier may comprise a plurality of individual cartridge identifiers (e.g., a cartridge may comprise a plurality of individual cartridge identifiers coupled to the cartridge). For example, a first cartridge identifier may have different dimensions from a second cartridge identifier. The second cartridge identifier may comprise a plurality of cartridge identifiers. Each cartridge identifier from the plurality of cartridge identifiers may be substantially similar to the first cartridge identifier (e.g., the second cartridge identifier comprises a plurality of first cartridge identifiers).

Figure 4:
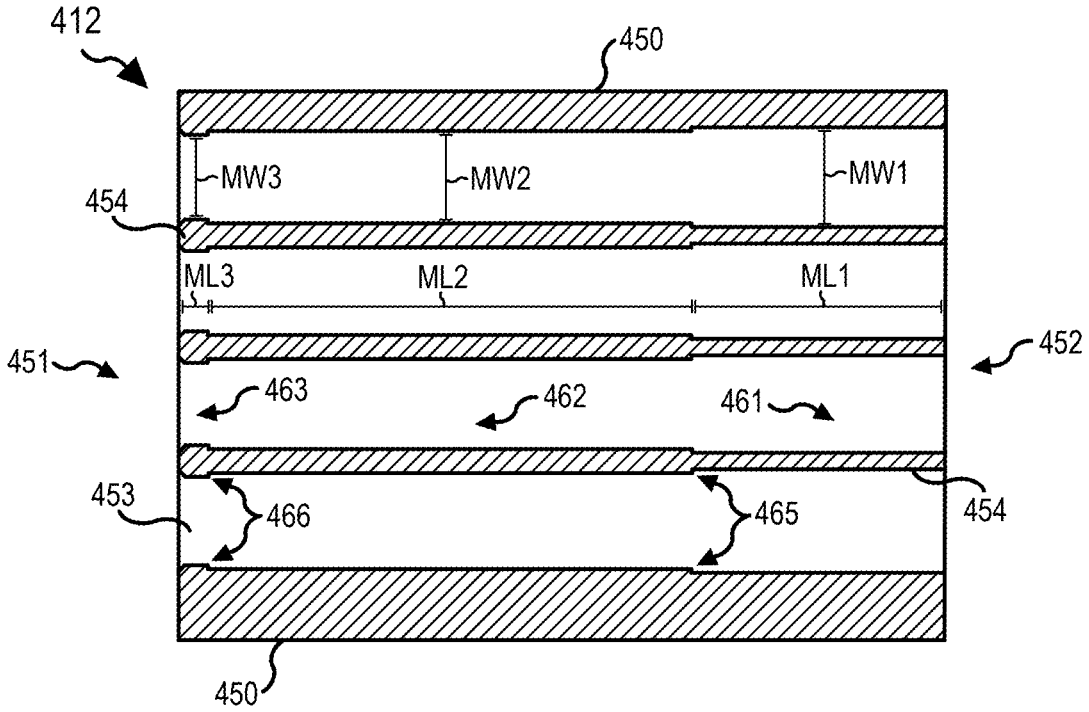
FIG. 4 is a cross-sectional view of a magazine for a CEW, in accordance with various embodiments.

In various embodiments, and with reference to FIG. 4 a magazine 412 is disclosed. Magazine 412 may be similar to any other magazine disclosed herein. Magazine 412 may comprise a housing 450 (e.g., a body) having a first end 451 (e.g., a deployment end, a front end, etc.) opposite a second end 452 (e.g., a loading end, a rear end, etc.). Housing 450 may comprise one or more bores 453. Each bore 453 may define an opening through housing 450. For example, each bore 453 may be defined by one or more walls 454 of housing 450. Each wall 454 may define an interior surface of housing 450 separating the one or more bores 453.

In various embodiments, a bore 453 may comprise a coating or secondary material. The coating or secondary material may cover at least a portion of the inner surface of a bore 453. For example, a bore 453 may comprise a rubber gasket configured to provide waterproofing and/or shock absorption. As a further example, a bore 453 may comprise an O-ring, radial seal, or the like. A bore 453 may comprise any suitable size or shape configured to receive a cartridge such as, for example, a square shape, a cylindrical shape, a hexagonal shape, and/or the like.

In various embodiments, each bore 453 may be sized and shaped to receive a cartridge having a specific type of cartridge. For example, a bore 453 may comprise one or more cartridge stops configured to position the cartridge within the bore 453. The one or more cartridge stops may define radially inward protrusions in the bore 453. The one or more cartridge stops may form a radially inward step changing or defining an inner diameter of the bore 453. The axial location of the one or more cartridge stops within the bore 453 may be based on the cartridge type the bore 453 is configured to receive.

In various embodiments, a bore 453 may comprise a first cartridge stop 465. First cartridge stop 465 may define a radially inward protrusion in the bore 453 between first end 451 and second end 452. First cartridge stop 465 may be configured to contact a cartridge at a first location on the cartridge to position the cartridge within bore 453. In some embodiments, in response to the cartridge comprising a cartridge type acceptable by the bore 453, an end of the cartridge may remain inward from first end 451 (e.g., the cartridge may not extend forward first end 451).

The bore 453 may define one or more portions (e.g., inner portions, sections, etc.) relative to first cartridge stop 465. For example, the bore 453 may define a first portion 461. First portion 461 may be defined from second end 452 to first cartridge stop 465. The bore may define a second portion. The second portion may be defined from first cartridge stop 465 to first end 451.

First portion 461 may comprise different dimensions than the second portion. For example, first portion 461 may comprise a first width MW1 (e.g., a first magazine width, a first bore width, etc.) and a first length ML1 (e.g., a first magazine length, a first bore length, etc.). The second portion may comprise a second width MW2 (e.g., a second magazine width, a second bore width, etc.) and a second length (depicted in FIG. 4 as ML2 combined with ML3). The second length of the second portion may be greater than the first length ML1 of first portion 461 (e.g., first length ML1 is less than the second length). The second width MW2 of the second portion may be less than the first width MW1 of first portion 461 (e.g., first width MW1 is greater than the second width MW2).

In various embodiments, a bore 453 may comprise first cartridge stop 465 and a second cartridge stop 466. As previously discussed, first cartridge stop 465 may define a radially inward protrusion (e.g., a first radially inward protrusion) in the bore 453 between first end 451 and second end 452. First cartridge stop 465 may be configured to contact a cartridge at a first location on the cartridge to position the cartridge within bore 453. Second cartridge stop 466 may define a radially inward protrusion (e.g., a second radially inward protrusion) in the bore 453 proximate first end 451. Second cartridge stop 466 may be configured to contact the cartridge at a second location on the cartridge. The second location may be different from the first location. The second location may comprise an end (e.g., a deployment end) of the cartridge. In that regard, first cartridge stop 465 may be configured to contact a cartridge at a first location on the body of the cartridge whereas second cartridge stop 466 may be configured to contact the cartridge at a second location on an end of the cartridge.

The bore 453 may define one or more portions (e.g., inner portions, sections, etc.) relative to first cartridge stop 465 and second cartridge stop 466. For example, the bore 453 may define first portion 461, a second portion 462, and a third portion 463. As previously discussed, first portion 461 may be defined from second end 452 to first cartridge stop 465. Second portion 462 may be defined from first cartridge stop 465 to second cartridge stop 466. Third portion 463 may be defined from second cartridge stop 466 to first end 451.

Each of first portion 461, second portion 462, and third portion 463 may comprise different dimensions. For example, as previously discussed first portion 461 may comprise a first width MW1 (e.g., a first magazine width, a first bore width, etc.) and a first length ML1 (e.g., a first magazine length, a first bore length, etc.). Second portion may comprise a second width MW2 (e.g., a second magazine width, a second bore width, etc.) and a second length ML2 (e.g., a second magazine length, a second bore length, etc.). Third portion may comprise a third width MW3 (e.g., a third magazine width, a third bore width, etc.) and a third length ML3 (e.g., a third magazine length, a third bore length, etc.). Second length ML2 may be greater than first length ML1 and third length ML3 (e.g., first length ML1 and third length ML3 are less than second length ML2). First length ML1 may be greater than third length ML3 (e.g., third length ML3 is less than first length ML1). First width MW1 may be greater than second width MW2 and third width MW3 (e.g., second width MW2 and third width MW3 are less than first width MW1). Second width MW2 may be greater than third width MW3 (e.g., third width MW3 is less than second width MW2).

Figure 5A:
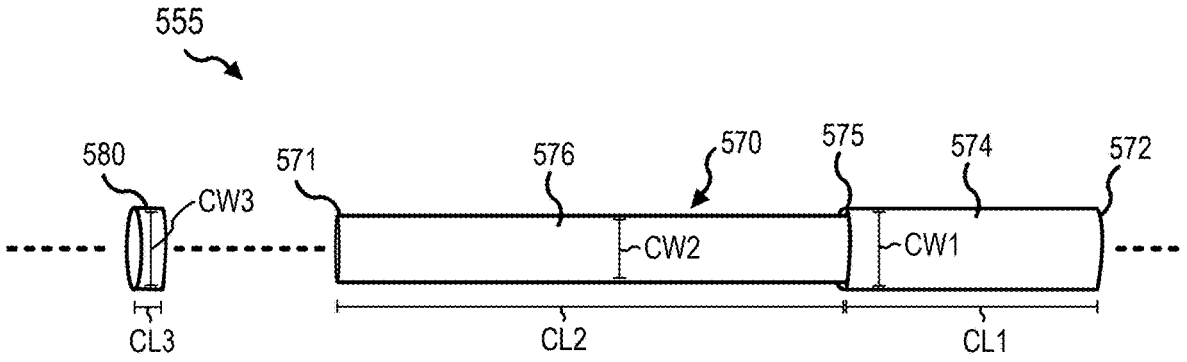
FIG. 5A is an exploded perspective view of a cartridge for a CEW, in accordance with various embodiments.
Figure 5B:
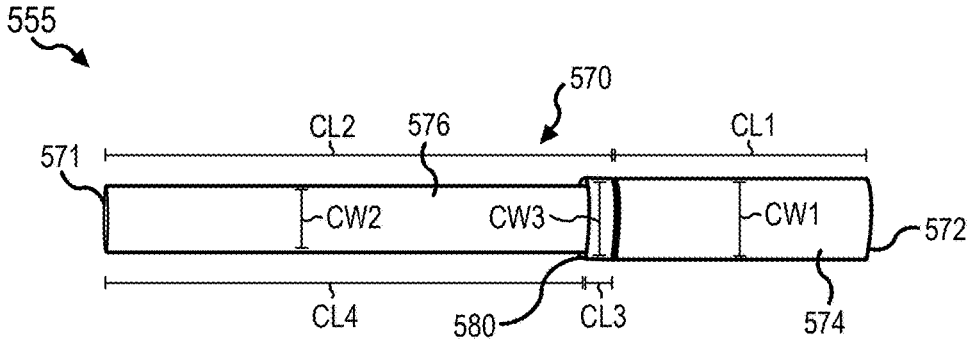
FIG. 5B is a perspective view of the cartridge of FIG. 5A, in accordance with various embodiments.

In various embodiments, and with reference to FIGS. 5A and 5B, a cartridge 555 comprising a cartridge identifier 580 is disclosed. Cartridge 555 may be similar to any other cartridge disclosed herein. Cartridge 555 may comprise a body 570 having a first end 571 (e.g., a deployment end) opposite a second end 572 (e.g., a contact end). Body 570 may comprise a cylindrical shape. Body 570 may comprise a monolithic structure, or may comprise separate structures coupled to form a singular body. Body 570 may be sized and shaped to be received within a bore of a magazine.

Body 570 may comprise a wide portion 574 (e.g., a base) and an elongated portion 576 (e.g., a firing tube). Wide portion 574 may define second end 572. Elongated portion 576 may define first end 571. Body 570 may define a step 575 between (and separating) wide portion 574 and elongated portion 576. Step 575 may define an outer surface of body 570 extending radially inward relative to wide portion 574. Step 575 may define an outer surface of body 570 extending radially outward relative to elongated portion 576. In that regard, wide portion 574 may define a portion of body 570 from second end 552 to step 575 and elongated portion 576 may define a portion of body 570 from first end 551 to step 575.

Wide portion 574 and elongated portion 576 may comprise different dimensions. For example, wide portion 574 may comprise a first width CW1 (e.g., a first cartridge width) and a first length CL1 (e.g., a first cartridge length). Elongated portion 576 may comprise a second width CW2 (e.g., a second cartridge width) and a second length CL2 (e.g., a second cartridge length). First width CW1 may be greater than second width CW2 (e.g., second width CW2 may be less than first width CW1). First length CL1 may be less than second length CL2 (e.g., second length CL2 may be greater than first length CL1).

In various embodiments, cartridge identifier 580 may be configured to identify a cartridge type of cartridge 555. Cartridge identifier 580 may also be configured to allow cartridge 555 to be removably inserted within a bore of a magazine configured to receive a cartridge type the same as the cartridge type of cartridge 555. Cartridge identifier 580 may be similar to any other cartridge identifier discussed herein.

In various embodiments, cartridge identifier 580 may comprise a physical property configured to indicate a cartridge type. The physical property may be configured to interface with a bore of a magazine to allow the magazine to correctly receive cartridge 555. The physical property may also visually indicate the cartridge type to a user. The physical property may comprise a dimension, such as a length, a width, or a depth of cartridge identifier 580. The physical property may comprise a color, a shape, a design, a material, and/or the like.

The physical property may comprise a material. For example, the material may be configured to receive an impact force in response to a deployment of cartridge 555. In that regard, the material may comprise a rubber material, a plastic material, or any other material configured to at least partially receive the impact force. For example, in some embodiments, the material may comprise a semi-crystalline polyamide. In some embodiments, the material may comprise a synthetic polymer. In some embodiments, the material may comprise nylon 6-6. The material of cartridge identifier 580 may be different from a material of cartridge 555 (e.g., cartridge identifier 580 comprises a first material, cartridge 555 comprises a second material, and the first material is different from the second material).

Cartridge identifier 580 may be sized and shaped to couple to an outer surface of body 570. For example, cartridge identifier 580 may comprise a ring shape, a partial ring shape, a full ring shape, and/or the like. Cartridge identifier 580 may be configured to couple to elongated portion 576. In some embodiments, cartridge identifier 580 may be configured to slide over elongated portion 576 to couple to elongated portion 576. Cartridge identifier 580 may couple to elongated portion 576 approximate step 575. Cartridge identifier 580 may contact step 575 while coupled to elongated portion 576.

In various embodiments, cartridge identifier 580 may comprise a body (e.g., a cartridge identifier body, etc.). The body of cartridge identifier 580 may be configured to couple to an outer surface of cartridge 555. The body of cartridge identifier 580 may comprise a cylindrical opening sized and shaped to slidably insert over, and couple to, the outer surface of body 570 of cartridge 555. The body of cartridge identifier 580 may comprise an outer surface (e.g., a cartridge identifier outer surface, etc.) opposite an inner surface (e.g., a cartridge identifier inner surface, etc.). In response to cartridge identifier 580 being coupled to cartridge 555, the inner surface of cartridge identifier 580 (e.g., the inner surface of the body of cartridge identifier 580) may contact and/or couple to the outer surface of body 570. For example, the inner surface of cartridge identifier 580 may contact and/or couple to elongated portion 576. In response to cartridge identifier 580 being coupled to cartridge 555, the outer surface of cartridge identifier 580 (e.g., the outer surface of the body of cartridge identifier 580) may be at least partially aligned with the outer surface of body 570. For example, the outer surface of cartridge identifier 580 may be at least partially aligned with the outer surface of wide portion 574. The body of cartridge identifier 580 may be coupled to the outer surface of cartridge 555 axially forward wide portion 574.

The body of cartridge identifier 580 may comprise a front edge (e.g., a first end, a cartridge identifier first end, etc.) opposite a rear edge (e.g., a second end, a cartridge identifier second end, etc.). The front edge of cartridge identifier 580 may comprise the edge closest to first end 571 of cartridge 555 in response to cartridge identifier 580 being coupled to cartridge 555. The rear edge of cartridge identifier 580 may comprise the edge closest to second end 572 of cartridge 555 in response to cartridge identifier 580 being coupled to cartridge 555. In response to cartridge identifier 580 being coupled to cartridge 555, the rear edge of cartridge identifier 580 (e.g., the rear edge of the body of cartridge identifier 580) may contact and/or couple to the outer surface of body 570. For example, the rear edge of cartridge identifier 580 may contact and/or couple to wide portion 574. The front edge of cartridge identifier 580 (e.g., the front edge of the body of cartridge identifier 580) may not contact and/or couple to the outer surface of body 570.

In various embodiments, cartridge identifier 580 may be coupled to cartridge 555 radially outward from elongated portion 576. Cartridge identifier 580 may be coupled to cartridge 555 axially forward wide portion 574.

Cartridge identifier 580 may comprise dimensions including a third width CW3 (e.g., a cartridge identifier width) and a third length CL3 (e.g., a cartridge identifier length). Third width CW3 may be greater than second width CW2 (e.g., second width CW2 may be less than third width CW3). Third width CW3 may be substantially similar to, or equal to, first width CW1. Third length CL3 may be less than first length CL1 and second length CL2 (e.g., first length CL1 and second length CL2 may each be greater than third length CL3).

In response to cartridge identifier 580 being coupled to body 570, elongated portion 576 may comprise an exposed length CLA (e.g., fourth length CL4). Exposed length CL4 may be a length of an outer surface of elongated portion 576 from cartridge identifier 580 to first end 571. In that regard, exposed length CL4 together with cartridge length CL3 may be the same as second length CL2. In embodiments where a bore of a magazine comprises both a first cartridge stop and a second cartridge stop, exposed length CL4 may be equal to the length between the first cartridge stop and the second cartridge stop (e.g., second magazine length ML2, with brief reference to FIG. 4). In embodiments where a bore of a magazine comprises only a first cartridge stop, exposed length CL4 may be less than or equal to the length between the first cartridge stop and the first end of the bore.

Figure 6:
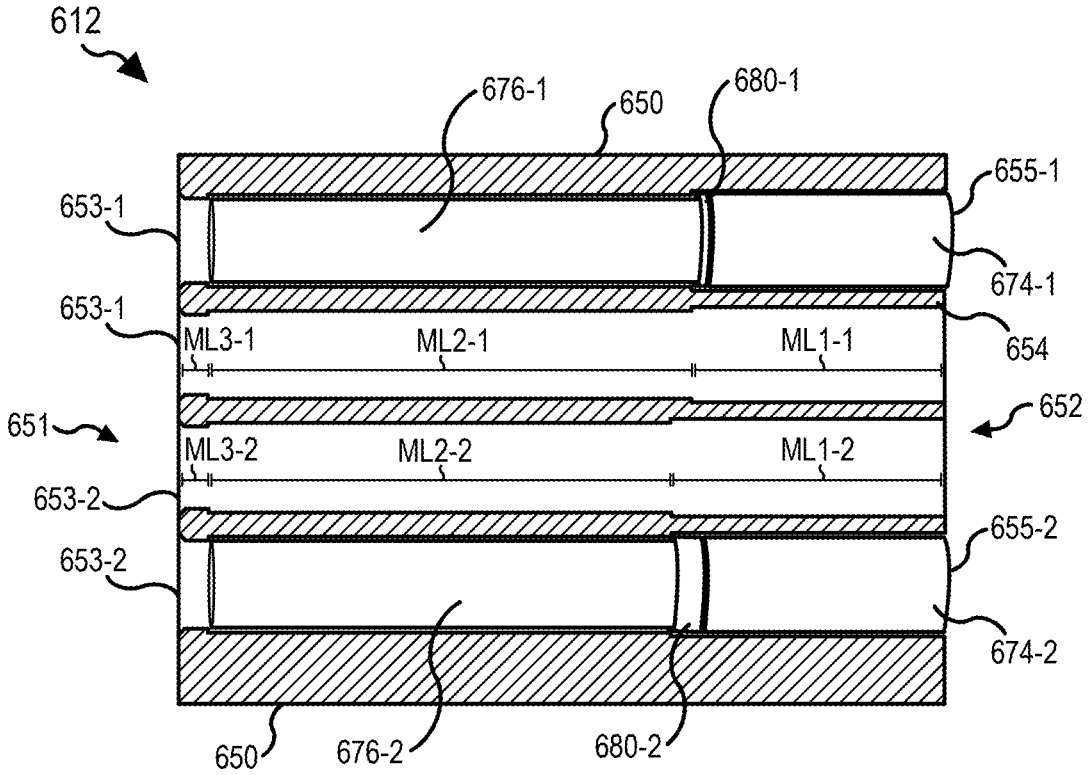
FIG. 6 is a cross-sectional view of a magazine for a CEW housing a first cartridge and a second cartridge, in accordance with various embodiments.

In various embodiments, and with reference to FIG. 6, a magazine 612 configured to receive cartridges having different cartridge types is disclosed. Magazine 612 may be similar to any other magazine disclosed herein. Magazine 612 may comprise a housing 650 (e.g., a body) having a first end 651 opposite a second end 652. Housing 650 may be similar to any other magazine housing, magazine body, or the like disclosed herein. Housing 650 may comprise one or more bores 653. Each bore 653 may define an opening through housing 650. For example, each bore 653 may be defined by one or more walls 654 of housing 650. Each wall 654 may define an interior surface of housing 650 separating the one or more bores 653.

In various embodiments, housing 612 may comprise a first plurality of bores 653-1 and a second plurality of bores 653-2 (and/or any other number of different bores). First plurality of bores 653-1 may be sized and shaped to receive a first type of cartridge. Second plurality of bores 653-2 may be sized and shaped to receive a second type of cartridge. Although described herein and depicted in FIG. 6 as a first plurality of bores and a second plurality of bores 653-2, it should be understood by one in the art that magazine 612 may comprise additional bores configured to receive different cartridge types (e.g., a third type of cartridge). Additionally, magazine 612 may comprise a single bore configured to receive a single cartridge type. The single cartridge type may be different from the first plurality of bores and the second plurality of bores 653-2, or may be a same type as one of the first plurality of bores or the second plurality of bores 653-2.

In various embodiments, a bore 653-1 may comprise a first cartridge stop and/or a second cartridge stop. Each cartridge stop may be similar to any other cartridge stop disclosed herein. The first cartridge stop may define a radially inward protrusion (e.g., a first radially inward protrusion) in the bore 653-1 between first end 651 and second end 652. The first cartridge stop may be configured to contact a cartridge (e.g., cartridge 655-1) at a first location on the cartridge to position the cartridge within bore 653-1. The second cartridge stop may define a radially inward protrusion (e.g., a second radially inward protrusion) in the bore 653-1 proximate first end 651. The second cartridge stop may be configured to contact the cartridge at a second location on the cartridge. The second location may be different from the first location. The second location may comprise an end (e.g., a deployment end) of the cartridge.

Bore 653-1 may define one or more portions (e.g., inner portions, sections, etc.) relative to the first cartridge stop and the second cartridge stop. For example, the bore 653-1 may define a first portion from second end 652 to the first cartridge stop, a second portion from the first cartridge stop to the second cartridge stop, and/or a third portion from the second cartridge stop to first end 651.

Each of portions may comprise different dimensions. For example, the first portion may comprise a first width (e.g., a first magazine width) and a first length ML1-1 (e.g., a first magazine length). The second portion may comprise a second width (e.g., a second magazine width) and a second length ML2-1 (e.g., a second magazine length). The third portion may comprise a third width (e.g., a third magazine width) and a third length ML3-1 (e.g., a third magazine length). Second length ML2-1 may be greater than first length ML1-1 and third length ML3-1 (e.g., first length ML1-1 and third length ML3-1 are less than second length ML2-1). First length ML1-1 may be greater than third length ML3-1 (e.g., third length ML3-1 is less than first length ML1-1). The first width may be greater than the second width and the third width (e.g., the second width and the third width are less than the first width). The second width may be greater than the third width (e.g., the third width is less than the second width).

A bore 653-1 may be configured to receive a first cartridge 655-1. First cartridge 655-1 may be similar to any other cartridge disclosed herein. First cartridge 655-1 may comprise a first wide portion 674-1, a first elongated portion 676-1, and/or a first cartridge identifier 680-1. First cartridge 655-1 may comprise a first cartridge type. First cartridge identifier 680-1 may be similar to any other cartridge identifier disclosed herein. First cartridge identifier 680-1 may comprise a physical property identifying first cartridge 655-1 as a first cartridge type and enabling first cartridge 655-1 to be received into bore 653-1. In response to being inserted into bore 653-1, first cartridge 655-1 may be configured to contact one or more cartridge stops within bore 653-1. In some embodiments, in response to the first cartridge 655-1 comprising a cartridge type acceptable by the bore 653-1, an end of first cartridge 655-1 may remain inward from first end 651 (e.g., first cartridge 655-1 may not extend forward first end 651).

In various embodiments, a bore 653-2 may comprise a third cartridge stop and/or a fourth cartridge stop. Each cartridge stop may be similar to any other cartridge stop disclosed herein. The third cartridge stop may define a radially inward protrusion (e.g., a third radially inward protrusion) in the bore 653-2 between first end 651 and second end 652. The third cartridge stop may be configured to contact a cartridge (e.g., cartridge 655-2) at a first location on the cartridge to position the cartridge within bore 653-2. The fourth cartridge stop may define a radially inward protrusion (e.g., a fourth radially inward protrusion) in the bore 653-2 proximate first end 651. The fourth cartridge stop may be configured to contact the cartridge at a second location on the cartridge. The fourth location may be different from the third location. The fourth location may comprise an end (e.g., a deployment end) of the cartridge.

Bore 653-2 may define one or more portions (e.g., inner portions, sections, etc.) relative to the third cartridge stop and the fourth cartridge stop. For example, the bore 653-1 may define a fourth portion from second end 652 to the third cartridge stop, a fifth portion from the third cartridge stop to the fourth cartridge stop, and/or a sixth portion from the fourth cartridge stop to first end 651.

Each of portions may comprise different dimensions. For example, the fourth portion may comprise a fourth width (e.g., a fourth magazine width) and a fourth length ML1-2 (e.g., a fourth magazine length). The fifth portion may comprise a fifth width (e.g., a fifth magazine width) and a fifth length ML2-2 (e.g., a fifth magazine length). The sixth portion may comprise a sixth width (e.g., a sixth magazine width) and a sixth length ML3-2 (e.g., a sixth magazine length). Fifth length ML2-2 may be greater than fourth length ML1-2 and sixth length ML3-2 (e.g., fourth length ML1-2 and sixth length ML3-2 are less than fifth length ML2-2). Fourth length ML1-2 may be greater than sixth length ML3-2 (e.g., sixth length ML3-2 is less than fourth length ML1-1). The fourth width may be greater than the fifth width and the sixth width (e.g., the fifth width and the sixth width are less than the fourth width). The fifth width may be greater than the sixth width (e.g., the sixth width is less than the fifth width).

In various embodiments, fourth length ML1-2 of bore 653-2 may be greater than first length ML1-1 of bore 653-1 (e.g., first length ML1-1 may be less than fourth length ML1-2). Fifth length ML2-2 of bore 653-2 may be less than second length ML2-1 of bore 653-1 (e.g., second length ML2-1 may be greater than fifth length ML2-2). Sixth length ML3-2 of bore 653-2 may be substantially similar to third length ML3-1 of bore 653-1.

A bore 653-2 may be configured to receive a second cartridge 655-2. Second cartridge 655-2 may be similar to any other cartridge disclosed herein. Second cartridge 655-2 may comprise a second wide portion 674-2, a second elongated portion 676-2, and/or a second cartridge identifier

680-2. Second cartridge 655-2 may comprise a second cartridge type. Second cartridge identifier 680-2 may be similar to any other cartridge identifier disclosed herein. Second cartridge identifier 680-2 may comprise a physical property identifying second cartridge 655-2 as a second cartridge type and enabling second cartridge 655-2 to be received into bore 653-2. In response to being inserted into bore 653-2, second cartridge 655-2 may be configured to contact one or more cartridge stops within bore 653-2. In some embodiments, in response to the second cartridge 655-2 comprising a cartridge type acceptable by the bore 653-2, an end of second cartridge 655-2 may remain inward from first end 651 (e.g., second cartridge 655-2 may not extend forward first end 651).

In various embodiments, first cartridge 655-1 and second cartridge 655-2 may comprise substantially similar bodies. For example, first wide portion 674-1 and second wide portion 674-2 may be similar in size, shape, and dimensions. First elongated portion 676-1 and second elongated portion 676-2 may also be similar in size, shape, and dimensions.

First cartridge identifier 680-1 may comprise different dimensions or properties from second cartridge identifier 680-2. For example, first cartridge identifier 680-1 may comprise a first physical property. Second cartridge identifier 680-2 may comprise a second physical property. The first physical property may be different from the second physical property. For example, first cartridge identifier 680-1 may comprise a first color, shape, and/or dimension, and second cartridge identifier 680-2 may comprise a second color, shape, and/or dimension. At least one of the first color, shape, and/or dimension may be different from at least one of the second color, shape, and/or dimension.

In some embodiments, first cartridge identifier 680-1 may comprise a first length and a first width. Second cartridge identifier 680-2 may comprise a second length and a second width. The first width of first cartridge identifier 680-1 may be substantially similar to the second width of second cartridge identifier 680-2. The first length of first cartridge identifier 680-1 may be less than the second length of second cartridge identifier 680-2 (e.g., the second length is greater than the first length). In that respect, a cartridge comprising first cartridge identifier 680-1 may be receivable into any bore of the first plurality of bores 653-1, but not correctly receivable into a bore of the second plurality of bores 653-2 (e.g., due to the shorter length of first cartridge identifier 680-1). A cartridge comprising second cartridge identifier 680-2 may be receivable into any bore of the second plurality of bores 653-2, but not correctly receivable into a bore of the first plurality of bores 653-1 (e.g., due to the longer length of second cartridge identifier 680-2).

In various embodiments, a cartridge identifier may be sized and shaped to at least partially receive an impact force (e.g., a first force) during deployment of a cartridge. For example, during a deployment a force from the deployment may cause the cartridge to move forward within a bore of a magazine. The forward movement may cause the cartridge to impact a surface within the bore of the magazine. For example, the bore of the magazine may comprise one or more cartridge stops, as discussed previously herein. The forward movement may cause the cartridge to impact one or more surfaces of one or more cartridge stops. In various embodiments, the impact force of the cartridge against the one or more surfaces of the bore of the magazine may over time cause degradation and/or damage to the magazine and/or cartridge. In various embodiments, continued degradation and/or damage to the magazine and/or cartridge may cause failure of the magazine and/or the cartridge.

In various embodiments, a cartridge identifier may be sized and shaped to at least partially impart a force (e.g., a second force) against a cartridge in response to the cartridge being loaded into a bore of a magazine. For example, the bore of the magazine may comprise one or more cartridge stops, as discussed previously herein. In response to a cartridge being inserted into the bore, the cartridge identifier may be compressed between a cartridge stop and a surface of the cartridge. The compression of the cartridge identifier may cause the cartridge identifier to impart an axial force against the cartridge. The axial force may help the cartridge couple to, or press against, one or more components within the handle of the CEW, in response to the magazine being coupled to the handle. For example, the handle may comprise electrical contacts, such as electrical pogo pins, configured to provide an electrical connection between the handle and one or more cartridges. The axial force provided by the cartridge identifier against the cartridge may at least partially aid in ensuring the cartridge establishes proper contact and coupling with the electrical contacts.

In various embodiments, a cartridge identifier may comprise a size and/or shape configured to at least partially compress and/or receive and distribute a force. For example, in some embodiments a cartridge identifier may comprise a spring and/or a spring shape. In some embodiments, a cartridge identifier may comprise structures and/or removed material configured to allow the cartridge identifier to at least partially compress and/or receive and distribute a force. As discussed previously herein, in various embodiments a cartridge identifier may also comprise a material configured to at least partially compress and/or receive and distribute a force. For example, a cartridge identifier may comprise a plastic material.

Figure 7A:
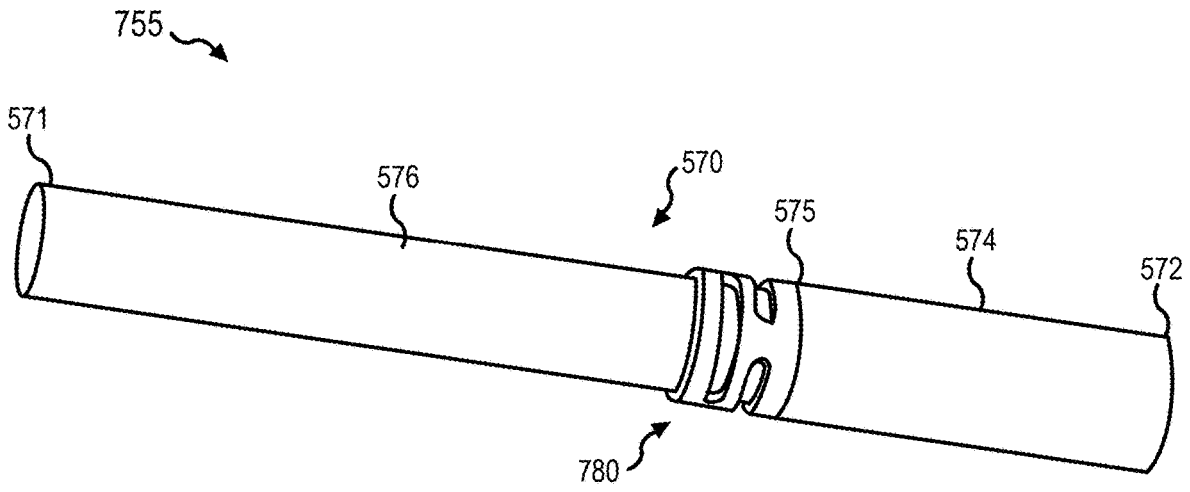
FIG. 7A is a perspective view of a cartridge for a CEW further comprising a cartridge identifier, in accordance with various embodiments.
Figure 7B:
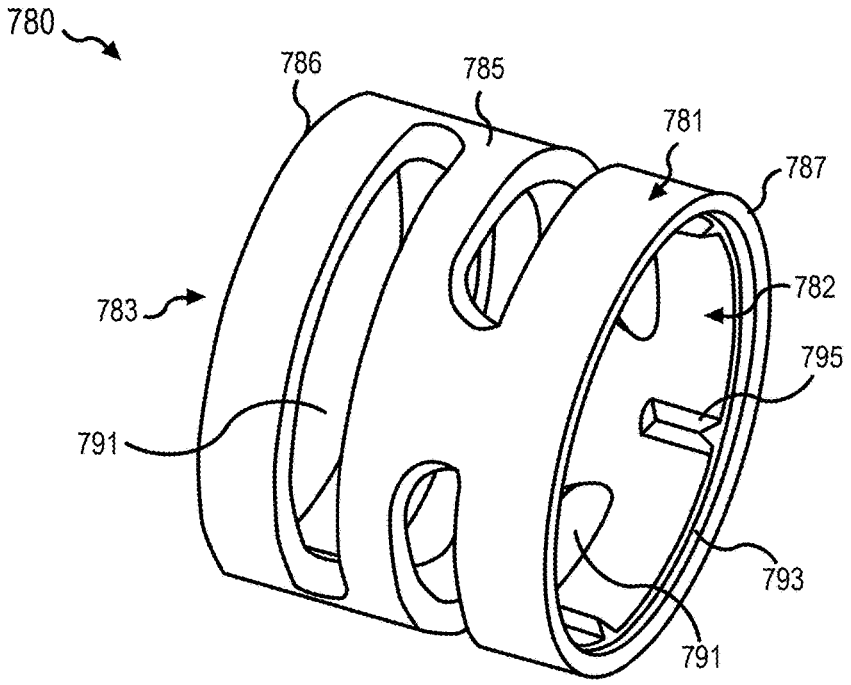
FIG. 7B is a perspective view of the cartridge identifier of FIG. 7A, in accordance with various embodiments.

In various embodiments, and with reference to FIGS. 7A and 7B, cartridge 555 comprising a cartridge identifier 780 is disclosed. Cartridge 555 was previously discussed with brief reference to FIGS. 5A and 5B, and may be similar to any other cartridge disclosed herein. In other embodiments, cartridge identifier 780 may also be coupled to any other suitable or desired cartridge.

In various embodiments, cartridge identifier 780 may be similar to any other cartridge identifier disclosed herein. Cartridge identifier 780 may be configured to identify a cartridge type of cartridge 555. Cartridge identifier 780 may also be configured to allow cartridge 555 to be removably inserted within a bore of a magazine configured to receive a cartridge type the same as the cartridge type of cartridge 555. Cartridge identifier 780 may also be configured to at least partially compress and/or receive and distribute a force against cartridge 555.

In various embodiments, cartridge identifier 780 may comprise a body 785 (e.g., a cartridge identifier body, etc.). Body 785 of cartridge identifier 780 may be configured to couple to an outer surface of cartridge 555. Body 785 of cartridge identifier 780 may comprise an outer surface 781 (e.g., a cartridge identifier outer surface, etc.) opposite an inner surface 782 (e.g., a cartridge identifier inner surface, etc.). Inner surface 782 may define an opening 783 through body 785. Opening 783 may be sized and shaped to slidably insert over, and couple to, the outer surface of body 570 of cartridge 555. Opening 783 may comprise any suitable shape, such as a cylindrical shape. Body 785 of cartridge identifier 780 may comprise a front edge 786 (e.g., a first end, a cartridge identifier first end, etc.) opposite a rear edge 787 (e.g., a second end, a cartridge identifier second end, etc.). Front edge 786 and rear edge 787 may be in fluid communication with opening 784. Front edge 786, rear edge 787, and inner surface 782 may collectively define opening 783. Front edge 786 may comprise the edge closest to first end 571 of cartridge 555 in response to cartridge identifier 780 being coupled to cartridge 555. Rear edge 787 may comprise the edge closest to second end 572 of cartridge 555 in response to cartridge identifier 780 being coupled to cartridge 555.

In various embodiments, in response to cartridge identifier 780 being coupled to cartridge 555, inner surface 781 may contact and/or couple to the outer surface of body 570. For example, inner surface 781 may contact and/or couple to elongated portion 576. In response to cartridge identifier 780 being coupled to cartridge 555, outer surface 781 may be at least partially aligned with the outer surface of body 570. For example, outer surface 781 may be at least partially aligned with the outer surface of wide portion 574. Body 785 may be coupled to the outer surface of cartridge 555 axially forward wide portion 574. In response to cartridge identifier 780 being coupled to cartridge 555, rear edge 787 may contact and/or couple to the outer surface of body 570. For example, rear edge 787 may contact and/or couple to wide portion 574. Front edge 786 may not contact and/or couple to the outer surface of body 570.

In various embodiments, body 785 may comprise one or more structures, materials, or the like, and/or one or more lack of structures, materials, or the like, to at least partially allow body 785 to compress in response to contact or force of body 785 against a surface of a bore or a magazine (e.g., a cartridge stop within a bore). For example, body 785 may comprise one or more voids 791. Each void 791 may define an opening (e.g., aperture, hole, etc.) through body 785. In that regard, each void 791 may be in fluid communication with opening 783. In that regard, in response to cartridge identifier 780 being couple to cartridge 555 an outer surface of elongated portion 576 may be visible through a void 791.

Body 785 may comprise any suitable number of voids 791. Each void 791 may comprise any suitable size and/or shape. Body 785 may comprise a plurality of voids 791 with each void 791 from the plurality of voids 791 oriented and/or arranged on body 785 at different locations. In some embodiments, a number of voids 791, a size and shape of each void 791, and/or an orientation of each void 791 may be selected based on a desired or needed amount of compression in body 785.

Each void 791 may be arranged on body 785 between front edge 786 and rear edge 787. Each void 791 may be oriented circumferentially around body 785. In some embodiments, one or more voids 791 may be staggered axially from front edge 786 to rear edge 787 (e.g., a first void is axially offset from a second void). In some embodiments, one or more voids 791 may be staggered circumferentially around the circumference of body 785 (e.g., a first void is circumferentially offset from a second void). Staggering axial and/or circumferential placement of one or more voids 791 may increase the compressibility of body 785, in accordance with various embodiments.

In various embodiments, inner surface 782 of body 785 may define a lip 793 proximate rear edge 787. Lip 793 may be radially outward from inner surface 782. Lip 793 may comprise a portion of body 785 having a thickness less than a thickness of the remainder of body 785 (e.g., body 785 comprises a first thickness, lip 793 comprises a second thickness, and the first thickness is greater than the second thickness). Lip 793 may define a circumferential surface proximate to, or at, rear edge 787. In various embodiments, lip 793 may be sized and shaped to at least partially ensure a closer coupling between cartridge identifier 780 and cartridge 555. In particular, lip 793 may be sized and shaped to at least partially ensure a closer (e.g., tighter) coupling between rear edge 787 and step 575 (e.g., to allow for manufacturing tolerances and/or defects).

In various embodiments, inner surface 782 of body 785 may define one or more protrusions 795. Each protrusion 795 may extend radially inward from inner surface 782. A protrusion 795 may comprise a portion of body 785 having a thickness greater than a thickness of the remainder of body 785 (e.g., body 785 comprises a first thickness, lip 793 comprises a second thickness, and protrusion 795 comprises a third thickness, the third thickness is greater than the first thickness, and the first thickness is greater than the second thickness).

In various embodiments, a protrusion 795 may be sized and shaped to at least partially ensure a closer coupling between cartridge identifier 780 and cartridge 555. In particular, a protrusion 795 may be sized and shaped to at least partially ensure a closer (e.g., tighter) coupling between cartridge identifier 780 and elongated portion 576. In that regard, in response to cartridge identifier 780 coupling to cartridge 555, each protrusion 795 may contact the outer surface of cartridge 555 at elongated portion 576.

In various embodiments, each protrusion 795 may be positioned on inner surface 782 at any suitable location between front edge 786 and rear edge 787. In some embodiments, a protrusion 795 may be positioned on inner surface 782 proximate rear edge 787. In some embodiments, a protrusion 795 may be positioned on inner surface 782 proximate lip 793. A portion of protrusion 795 may contact and/or at least partially defined a raised surface proximate to lip 793. Each protrusion 795 may be circumferentially offset (e.g., a first protrusion is circumferentially offset from a second protrusion). Each protrusion 795 may be oriented axially and extend from rear edge 787 in a direction towards front edge 786.

In various embodiments, a magazine for a conducted electrical weapon is disclosed. The magazine may include a body having a first end opposite a second end; and a bore defining an opening through the body, wherein the bore is sized and shaped to receive a type of cartridge, and wherein the bore comprises a cartridge stop defining a radially inward protrusion in the bore between the first end and the second end.

In various embodiments, the bore may define a first portion from the second end to the cartridge stop and a second portion from the first end to the cartridge stop, and wherein the first portion comprises different dimensions than the second portion. The first portion may comprise a first length and the second portion comprises a second length, and wherein the second length is greater than the first length. The first portion may comprise a first width and the second portion comprises a second width, and wherein the first width is greater than the second width. The bore may comprise a cylindrical shape. The magazine may further comprise a cartridge removably inserted within the bore, wherein in response to being inserted within the bore the cartridge is configured to contact the cartridge stop while an end of the cartridge remains inward from the first end of the body. The cartridge may comprise a cartridge identifier coupled to an outer surface of the cartridge, and wherein the cartridge identifier is configured to contact the cartridge stop in response to the cartridge being inserted within the bore. The bore may further comprise a second cartridge stop defining a second radially inward protrusion in the bore proximate the first end. The bore may define a first portion from the second end to the cartridge stop, a second portion from the cartridge stop to the second cartridge stop, and a third portion from the second cartridge stop to the first end, and wherein each of the first portion, the second portion, and the third portion comprise different dimensions. The first portion may comprise a first length, the second portion may comprise a second length, and the third portion may comprise a third length, wherein the second length is greater than the first length, and wherein the first length is greater than the third length. The first portion may comprise a first width, the second portion may comprise a second width, and the third portion may comprise a third width, wherein the first width is greater than the second width, and wherein the second width is greater than the third width. The magazine may further comprise a cartridge removably inserted within the bore, wherein in response to being inserted within the bore the cartridge is configured to contact the cartridge stop at a first location on the cartridge and the second cartridge stop at a second location on the cartridge. The cartridge may comprise a cartridge identifier coupled to an outer surface of the cartridge at the first location, and wherein the cartridge identifier is configured to contact the cartridge stop in response to the cartridge being inserted within the bore.

In various embodiments, a cartridge for a conducted electrical weapon is disclosed. The cartridge may comprise a body comprising a wide portion and an elongated portion, wherein the body defines a step between the wide portion and the elongated portion; and a cartridge identifier coupled to the elongated portion proximate the step, wherein the cartridge identifier comprises a physical property indicating a cartridge type.

In various embodiments, the physical property may comprise at least one of a length or a width. The physical property may comprise at least one of a color, a shape, or a design. The cartridge identifier may comprise a material configured to receive an impact force in response to the cartridge being deployed. The material of the cartridge identifier may comprise at least one of a rubber or a plastic. The body may comprise a second material, and wherein the material of the cartridge identifier is different from the second material of the body. The wide portion may comprise a first width, the elongated portion may comprise a second width, and the first width is greater than the second width. The cartridge identifier may comprise a third width, and wherein the third width is greater than the second width. The cartridge identifier may comprise a third width, and wherein the third width is substantial similar to the first width. The wide portion may comprise a first length, the elongated portion may comprise a second length, and the second length is greater than the first length. The cartridge identifier may comprise a third length, and wherein the third length is smaller than the first length and the second length. The cartridge type may comprise a rubber bullet type, a standard electrode type, an article penetrating electrode type, an entangling projectile type, a scent-based projectile type, a pepper spray projectile type, or a tear gas projectile type.

In various embodiments, a magazine for a conducted electrical weapon is disclosed. The magazine may comprise a body having a first end opposite a second end; a first bore defining a first opening through the body, and wherein the first bore comprises a first cartridge stop positioned in the first bore at a first axial position between the first end and the second end; and a second bore defining a second opening through the body, and wherein the second bore comprises a second cartridge stop positioned in the second bore at a second axial position between the first end and the second end, and wherein the first axial position is different from the second axial position.

In various embodiments, the first bore may be sized and shaped to receive a first type of cartridge, wherein the second bore may be sized and shaped to receive a second type of cartridge, and wherein the first type of cartridge is different from the second type of cartridge. The first bore may define a first portion from the second end to the first cartridge stop and a second portion from the first end to the first cartridge stop, wherein the second bore may define a third portion from the second end to the second cartridge stop and a fourth portion from the first end to the second cartridge stop, and wherein each of the first portion, the second portion, the third portion, and the fourth portion may comprise different dimensions. The first portion may comprise a first length and the third portion may comprise a second length, and wherein the first length is different from the second length. The second portion may comprise a third length and the fourth portion may comprise a fourth length, and wherein the third length is different from the fourth length. The magazine may further comprise a first cartridge removably inserted within the first bore and a second cartridge removably inserted within the second bore, wherein in response to being inserted within the first bore the first cartridge may be configured to contact the first cartridge stop while a first cartridge end of the first cartridge remains inward from the first end of the body, and wherein in response to being inserted within the second bore the second cartridge may be configured to contact the second cartridge stop while a second cartridge end of the second cartridge remains inward from the first end of the body. The first cartridge may comprise a first cartridge identifier sized and shaped to allow the first cartridge to be removably inserted within the first bore, and wherein the second cartridge may comprise a second cartridge identifier sized and shaped to allow the second cartridge to be removably inserted within the second bore. The first cartridge may comprise a first elongated portion and a first wide portion, wherein the second cartridge may comprise a second elongated portion and a second wide portion, wherein the first wide portion may be sized and shaped similar to the second wide portion, and wherein the first elongated portion may be sized and shaped similar to the second elongated portion. The first cartridge identifier may be coupled to the first elongated portion of the first cartridge, wherein the second cartridge identifier may be coupled to the second elongated portion of the second cartridge, and wherein the first cartridge identifier may comprise a different physical property than the second cartridge identifier. The first cartridge identifier may comprise a first length and the second cartridge identifier may comprise a second length, and wherein the first length is different from the second length. The second cartridge identifier may comprise a plurality of cartridge identifiers, and wherein each cartridge identifier from the plurality of cartridge identifiers may be substantially similar to the first cartridge identifier.

In various embodiments, a cartridge identifier for a cartridge of a conducted electrical weapon is disclosed. The cartridge identifier may comprise a body having a front edge opposite a rear edge. The body may comprise an outer surface opposite an inner surface. The inner surface may define an opening extending through the body. The body may comprise a void defining an aperture through the outer surface of the body. The void may be in fluid communication with the opening.

In various embodiments, the cartridge identifier may comprise a plurality of voids. One or more voids from the plurality of voids may be circumferentially offset. One or more voids from the plurality of voids may be axially offset.

In various embodiments, the inner surface of the body may define a lip proximate the rear edge. In various embodiments, the inner surface of the body may define one or more protrusions extending radially inward from the inner surface. The protrusions may be proximate the rear edge of the cartridge identifier.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures. The scope of the disclosure is accordingly to be limited by nothing other than the appended claims and their legal equivalents, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B, and C may be present in a single embodiment; for example, A and B, A and C, B and C, or A and B and C.

Systems, methods, and apparatus are provided herein. In the detailed description herein, references to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments. Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A cartridge for a conducted electrical weapon comprising:

a body comprising a wide portion and an elongated portion, wherein the body defines a step between the wide portion and the elongated portion; and a cartridge identifier coupled to the elongated portion proximate the step, wherein the cartridge identifier is configured to compress against the step in response to receiving a force.

2. The cartridge of claim 1, wherein the body comprises a first material, the cartridge identifier comprises a second material, and the first material is different from the second material.

3. The cartridge of claim 2, wherein the second material comprises a rubber material or a plastic material.

4. The cartridge of claim 1, wherein the cartridge identifier is configured to axially compress against the step.

5. The cartridge of claim 1, wherein the cartridge identifier comprises a first material, wherein the body comprises a second material, and wherein the first material is different from the second material.

6. The cartridge of claim 5, wherein the first material comprises a rubber material or a plastic material.

7. The cartridge of claim 1, wherein the cartridge identifier comprises a physical structure configured to compress in response to the cartridge identifier receiving the force.

8. The cartridge of claim 7, wherein the physical structure comprises a spring shape.

9. The cartridge of claim 8, wherein the cartridge identifier comprises a plurality of voids, and wherein the plurality of voids forms the spring shape.

10. The cartridge of claim 9, wherein a first void from the plurality of voids is at least one of circumferentially offset or axially offset from a second void from the plurality of voids.

11. A cartridge identifier for a cartridge of a conducted electrical weapon, the cartridge identifier comprising:

a body comprising a ring shape configured to couple to an outer surface of the cartridge; and an opening defined axially through the body, wherein the opening is sized and shaped to receive the cartridge in response to the body coupling to the outer surface of the cartridge, and wherein the body is configured to compress against the outer surface of the cartridge in response to receiving a force.

12. The cartridge identifier of claim 11, further comprising a void defined radially through the body, wherein the void is in fluid communication with the opening.

13. The cartridge identifier of claim 12, wherein the void comprises a plurality of voids, and wherein a first void of the plurality of voids is at least one of circumferentially offset or axially offset from a second void of the plurality of voids.

14. The cartridge identifier of claim 13, wherein the plurality of voids is numbered, sized, shaped, and oriented based on an amount of compression of the body in response to receiving the force.

15. The cartridge identifier of claim 11, further comprising a lip proximate a rear edge of the body, wherein the lip defines a portion of an inner surface of the body radially outward from a remaining portion of the inner surface of the body.

16. The cartridge identifier of claim 11, further comprising a protrusion extending radially inward from an inner surface of the body.

17. The cartridge identifier of claim 16, wherein the protrusion comprises a plurality of protrusions, and wherein a first protrusion of the plurality of protrusions is circumferentially offset from a second protrusion of the plurality of protrusions.

18. The cartridge identifier of claim 11, wherein the body is configured to axially compress in response to receiving the force.

19. The cartridge identifier of claim 11, further comprising:

a plurality of voids defined radially through the body between a front edge and a rear edge of the body, wherein the plurality of voids is in fluid communication with the opening;

a lip defined on an inner surface of the body proximate the rear edge of the body; and a plurality of protrusions defined on the inner surface of the body, wherein the plurality of protrusions extend radially from the inner surface of the body.

20. The cartridge identifier of claim 19, wherein the plurality of protrusions extend axially from the lip towards the front edge of the body.

* * * * *